US006522845B2

(12) United States Patent
Sameshima

(10) Patent No.: US 6,522,845 B2
(45) Date of Patent: Feb. 18, 2003

(54) IMAGE FORMING APPARATUS AND IMAGE FORMING UNIT DETACHABLY ATTACHABLE THERETO

(75) Inventor: Takao Sameshima, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/971,664

(22) Filed: Oct. 9, 2001

(65) Prior Publication Data

US 2002/0048466 A1 Apr. 25, 2002

(30) Foreign Application Priority Data

Oct. 12, 2000 (JP) ..... 2000/311548
Jan. 30, 2001 (JP) ..... 2001/021126

(51) Int. Cl.[7] ..... G03G 15/00

(52) U.S. Cl. ..... 399/88; 399/90; 399/111; 399/37; 399/121

(58) Field of Search ..... 399/37, 88, 89, 399/90, 111, 121, 125, 302, 308; 439/55, 68, 76.1, 620

(56) References Cited

U.S. PATENT DOCUMENTS 5,587,769 A 12/1996 Sawada et al.
5,652,948 A * 7/1997 Sakaguchi et al. ..... 399/66
5,802,427 A 9/1998 Sawada et al. ..... 399/122
5,887,228 A * 3/1999 Motohashi et al. ..... 399/111
6,349,182 B2 * 2/2002 Otsubo et al. ..... 399/12

FOREIGN PATENT DOCUMENTS

JP 8-137181 5/1996
JP 10-301464 11/1998
JP 11-295998 10/1999

OTHER PUBLICATIONS

U.S. patent application Ser. No. 09/793,096, Sameshima, et al., filed Feb. 27, 2001.

* cited by examiner

*Primary Examiner*—Hoang Ngo
(74) *Attorney, Agent, or Firm*—Fitzpatrick, Cella, Harper & Scinto

(57) ABSTRACT

An image forming unit detachably attachable to an image forming apparatus has an image bearing body, a charging device for charging the image bearing body, a first unit having the image bearing body and the charging device, an intermediate transferring body, a transferring device for transferring a toner image on the image bearing body to the intermediate transferring body, and a second unit having the intermediate transferring body and the transferring device. One of the first unit and the second unit is supplied with electrical power through the other unit.

26 Claims, 21 Drawing Sheets

IMAGE FORMING APPARATUS AND IMAGE FORMING UNIT DETACHABLY ATTACHABLE THERETO

BACKGROUND OF THE INVENTION

1. Field of the Invention

This invention relates to an image forming apparatus such as a copier or a printer using the electrophotographic process, and particularly to an image forming unit detachably attachable to the image forming apparatus.

2. Description of the Related Art

In an electrophotographic image forming apparatus, a toner image formed on a photosensitive drum, which is an image bearing member, is transferred to a transferring material to thereby form an image, and as a color image forming apparatus, use has been made of one having a construction in which respective color toner images successively formed on a photosensitive drum are superimposed and transferred to an intermediate transferring body, and the color images are collectively transferred to a transferring material. In this case, in order to facilitate the handling of the deterioration of the photosensitive drum, etc. and consumptive members, a unit into which these are made and which is made detachably attachable to the main body of the apparatus has come to be widely used.

In a color image forming apparatus thus using an intermediate transferring body, as shown in Japanese Patent Application Laid-Open No. 8-137181, Japanese Patent Application Laid-Open No. 10-301464 and Japanese Patent Application Laid-Open No. 11-295998, a photosensitive body unit and an intermediate transferring body unit are of independent-unit construction, and are designed to be dismountable when the units have reached the end of their lives or during the treatment of a jam.

The apparatus of Japanese Patent Application Laid-Open No. 8-137181 is of a construction in which a movable side frame on the front of the apparatus is pivotally moved downwardly of the front of the apparatus and opened, whereby the photosensitive body unit and the intermediate transferring body unit are detachably attached from above. Also, in Japanese Patent Application Laid-Open No. 10-301464, the design of the device is such that the photosensitive body unit and the intermediate transferring body unit are detachably attached to movable members that can be horizontally drawn out to the front of the main body of the apparatus independently of each other. These two embodiments carry out the attachment and detachment of the units in a direction parallel to the conveying direction of the transferring material (these will hereinafter be referred to as "Conventional Example 1").

On the other hand, in Japanese Patent Application Laid-Open No. 11-295998, the design of the device is such that the units are slid in a direction perpendicular to the conveying direction of the transferring material and are thereby attached or detached (this will hereinafter be referred to as "Conventional Example 2").

The high voltage contact construction of an image forming apparatus like Conventional Example 1 is such that for example, a high voltage contact for receiving the supply of a bias voltage to primary transferring means provided in the intermediate transferring body unit and cleaning means, and the ground contact of a secondary transferring opposed roller are provided on the side of the intermediate transferring body unit, and are connected to contact means constituted by a contact pin and a compression spring provided on the side of a movable body, and are further connected to the main body of the image forming apparatus by the movable body being pushed into the main body of the apparatus.

Also, a high voltage contact for receiving the supply of a bias voltage to charging means provided in the photosensitive body unit is provided on the side or the upper surface of the photosensitive body unit, and is designed to be inserted into the main body of the image forming apparatus and thereby connected thereto, and a high voltage contact portion is provided at a separate position in each unit.

As the construction of the contact portion, besides the aforedescribed construction by the contact pin and the compression spring, one using a leaf spring is popular.

In the image forming apparatus of the construction as shown in Conventional Example 2 wherein each unit is attached or detached by being slid in a direction perpendicular to the conveying direction of the transferring material, it is usual to adopt a construction in which floating connectors provided on the inner side of the sliding direction of each unit and the side of the frame of the main body of the apparatus are connected together by the unit being inserted.

However, the above-described embodiments of the conventional art have suffered from the following problems.

In the image forming apparatus of the construction as shown in Conventional Example 1, a high voltage contact corresponding to each unit is provided on the side of the frame of the main body of the apparatus and therefore, high voltage wiring must be done from a high voltage substrate to respective separate positions, thus leaving problems in terms of the assembling property and cost.

Also, in the image forming apparatus of the construction as shown in Conventional Example 2, an opening portion for attaching and detaching each unit becomes necessary in the frame of the main body of the apparatus, and this adversely affects the rigidity of the frame of the entire apparatus. Further, as in Conventional Example 1, a high voltage contact corresponding to each unit is provided on the side of the frame of the main body of the apparatus and therefore, high voltage wiring must be done from a high voltage substrate to respective separate positions, thus leaving problems in terms of the assembling property and cost.

SUMMARY OF THE INVENTION

It is an object of the present invention to provide an image forming unit and an image forming apparatus in which wiring is simplified and the assembling property of the unit is improved.

It is another object of the present invention to provide an image forming unit and an image forming apparatus in which the number of the constituent parts of the unit is decreased to thereby achieve the downsizing and reduced cost of the whole of the main body of the apparatus.

It is another object of the present invention to provide an image forming unit and an image forming apparatus comprising an image bearing body, charging means for charging the image bearing body, a first unit having the image bearing body and the charging means, an intermediate transferring body, transferring means for transferring a toner image on the image bearing body to the intermediate transferring body, and a second unit having the intermediate transferring body and the transferring means, one of the first unit and the second unit being supplied with electric power through the other unit.

It is another object of the present invention to provide an image forming unit and an image forming apparatus comprising an image bearing body, an intermediate transferring belt to which a toner image on the image bearing body is transferred, and a rotary member over which the intermediate transferring belt is passed, the rotary member being an opposed electrode common to a plurality of members supplied with electric power.

Further, objects of the present invention will become apparent from the following description.

DESCRIPTION OF THE PREFERRED EMBODIMENTS

An image forming unit and an image forming apparatus according to an embodiment of the present invention will hereinafter be described with reference to the drawings.

Figure 1:
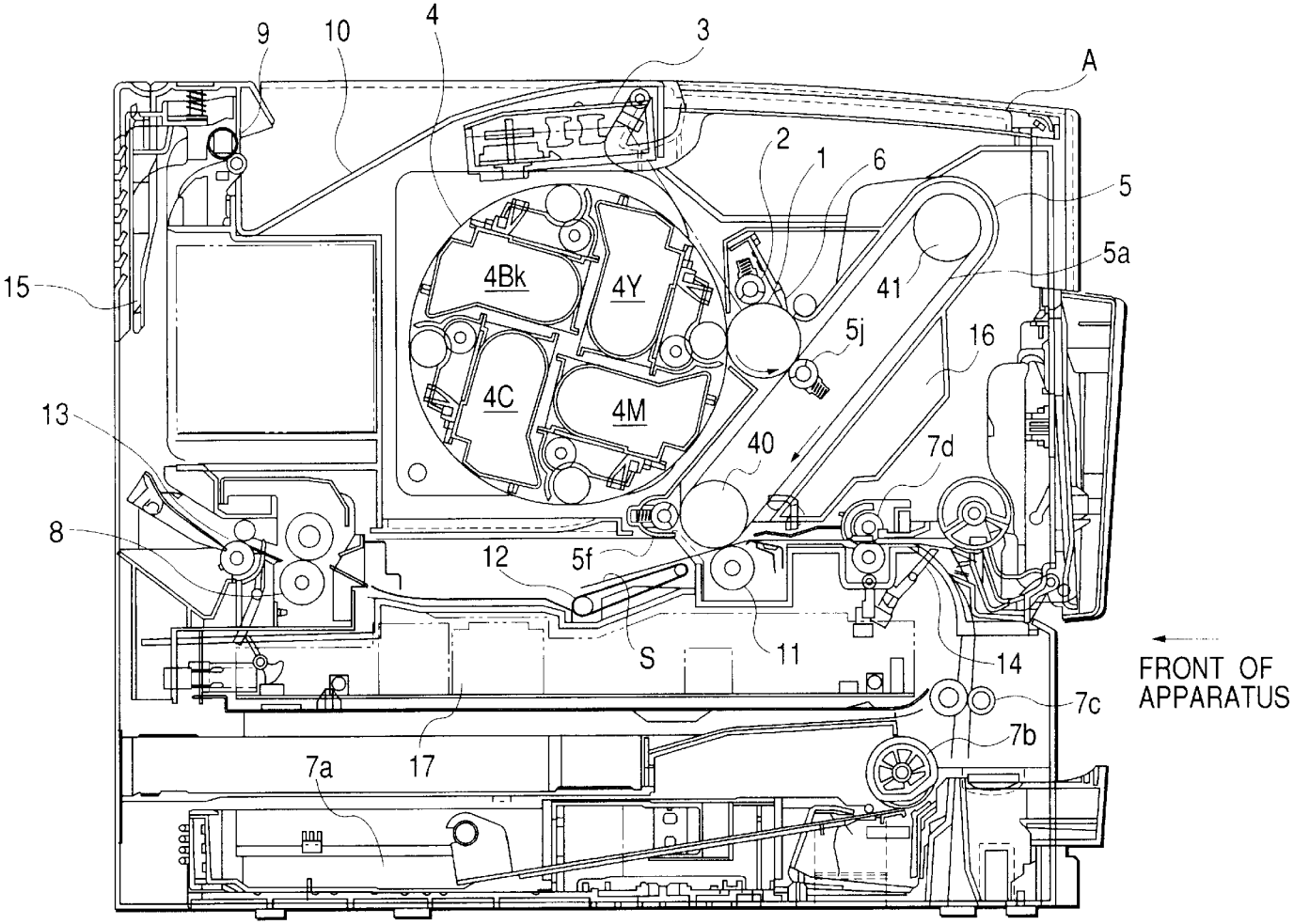
FIG. 1 is a main longitudinal cross-sectional illustration of an image forming apparatus which is an embodiment of the present invention.

FIG. 1 is a longitudinal cross-sectional illustration schematically showing the construction of an electrophotographic image forming apparatus A according to a first embodiment, i.e., a four-full-color laser beam printer, and the right side of the figure is the front of the apparatus.

General Construction of the Image Forming Apparatus

A photosensitive drum 1 as an image bearing body is rotated in the direction of arrow in FIG. 1 (counter-clockwise direction) in synchronism with the rotation of an endless-belt-shaped intermediate transferring belt 5*a* as an intermediate transferring body, and the surface of this photosensitive drum 1 is uniformly charged by a charging roller 2 as a charging apparatus and also the application of the light of a yellow image is effected by exposing means 3, whereby a yellow electrostatic latent image is formed on the photosensitive drum 1. Simultaneously with the formation of this electrostatic latent image, a developing apparatus 4 is driven to thereby dispose a yellow developing device 4Y at a developing position, and a voltage of the same polarity and substantially the same potential as the charging polarity of the photosensitive drum 1 is applied so that a yellow toner may adhere to the electrostatic latent image on the photosensitive drum 1, to thereby make the yellow toner adhere to the electrostatic latent image and develop it. Thereafter, a voltage opposite in polarity to the toner is applied to the presser roller (primary transferring roller) 5*j* of the intermediate transferring belt 5*a* to thereby primary-transfer the yellow toner image on the photosensitive drum 1 onto the intermediate transferring belt 5*a*.

When the primary transfer of the yellow toner image is terminated in the manner described above, the next developing device is moved round to and positioned at the developing position opposed to the photosensitive drum, and in the same manner as in the case of yellow, with respect to respective colors, i.e., magenta, cyan and black, the formation of electrostatic latent images, the development by respective color developing devices 4M, 4C and 4Bk and primary transfer are effected successively, and four color toner images are superimposed on the intermediate transferring belt 5*a*.

In the meantime, a secondary transferring roller 11 is in non-contact with the intermediate transferring belt 5*a*. At this time, a charging roller 5*f* as cleaning charging means is also positioned in a non-contact state with the intermediate transferring belt 5*a*.

After the completion of the formation of toner images of the four colors on the intermediate transferring belt 5*a*, the secondary transferring roller 11 is brought into pressure contact with the intermediate transferring belt 5*a* (the state of FIG. 1), and further, in synchronism with the rotation of the intermediate transferring belt 5*a*, a transferring material, which is a recording material conveyed from a transferring material cassette 7*a* by a feeding roller 7*b* and a pair of conveying rollers 7*c* as conveying means and waiting at a predetermined position near a pair of registration rollers 7*d*, is fed to the nip portion between the intermediate transferring belt 5*a* and the secondary transferring roller 11.

Immediately before the pair of registration rollers 7*d*, there is provided an ante-registration sensor 14 for detecting the leading end of the transferring material S and cutting off the rotative driving force of the pair of registration rollers 7*d*, and making the transferring material S wait at the predetermined position.

Further, a voltage opposite in polarity to the toners is applied to the secondary transferring roller 11, and the toner images on the intermediate transferring belt 5*a* are collectively secondary-transferred to the surface of the transferring material S conveyed thereto.

The transferring material S to which the toner images have been thus transferred comes to a fixing device 8 via a conveying belt unit 12, and the fixing of the toner images of the plurality of colors is effected there, whereafter the transferring material S is conveyed along a delivery guide 15 by a pair of delivery rollers 13, and is delivered onto a delivery tray 10 in the upper portion of the color image forming apparatus A by a pair of delivery rollers 9, thus completing image formation.

On the other hand, after the secondary transfer, the charging roller 5*f* for cleaning is brought into pressure contact with the intermediate transferring belt 5*a,* and induces predetermined charges (e.g. charges of the opposite polarity to the regular charging polarity of the toners) in residual toners remaining on the intermediate transferring belt, thereby collecting the residual toners. That is, this collecting means induces the charges of the opposite polarity in the residual toners in the aforedescribed manner, and causes them to electrostatically adhere to the photosensitive drum by the primary transferring roller 5*j,* and thereafter collects them by a cleaning blade 6 for the photosensitive drum. The thus collected residual toners follow a carrying path for carrying them as waste toners, and are collected and accumulated in a waste toner box 16.

Also, when image formation is to be continuously effected on a plurality of transferring materials, the aforementioned residual toners charged by the cleaning charging roller 5*f* are electrostatically transferred from the intermediate transferring belt 5*a* to the photosensitive drum 1 and simultaneously therewith, toner images for the next transferring material formed on the photosensitive drum 1 are primary-transferred to the intermediate transferring belt 5*a*. Thereby, the throughput of image formation can be improved.

Image Forming Unit

The construction of an image forming unit integrally constituted by the photosensitive drum and the intermediate transferring belt, which is detachably attached to the aforedescribed image forming apparatus, will now be described.

Figure 2:
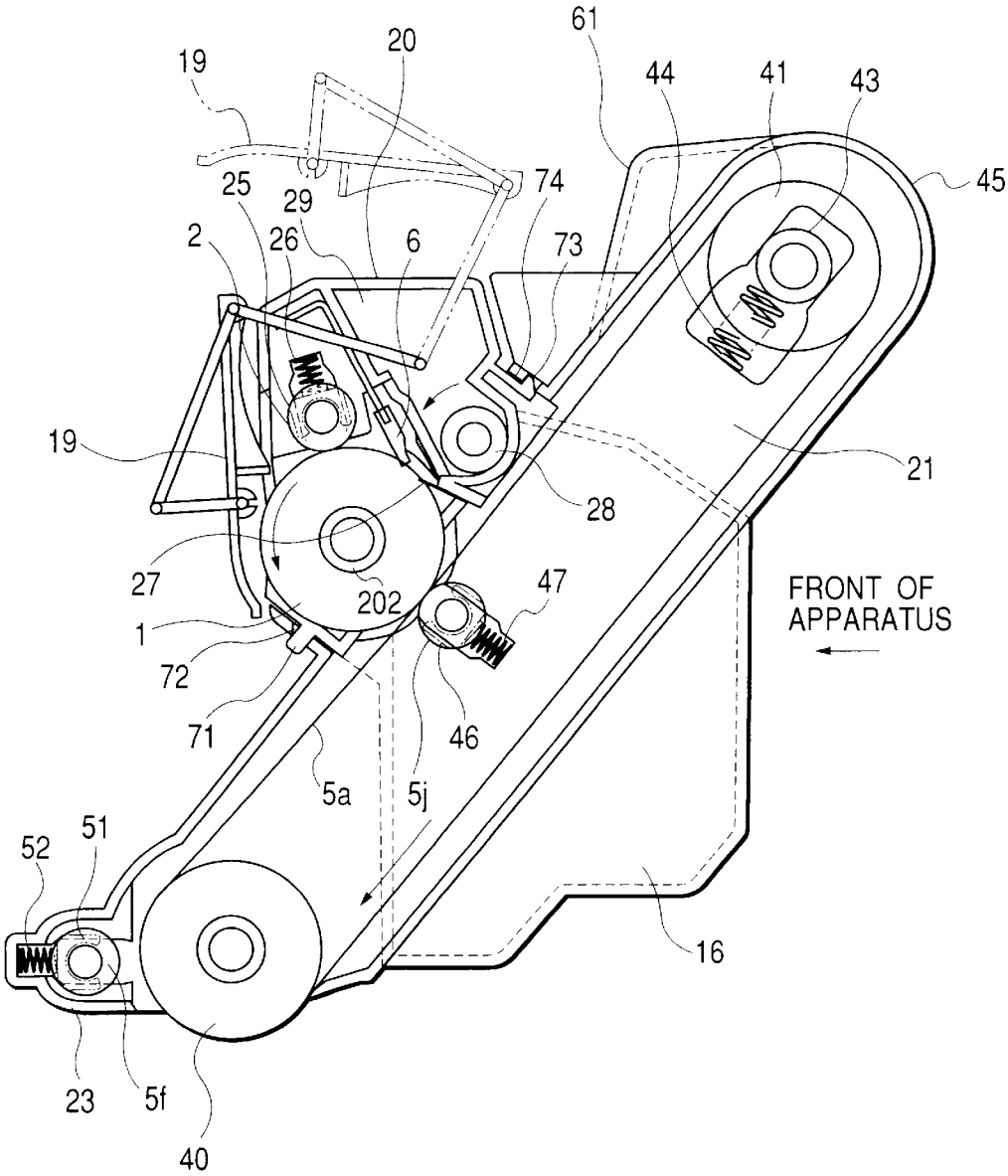
FIG. 2 is a left main longitudinal cross-sectional illustration of an image forming unit which is an embodiment of the present invention.
Figure 3:
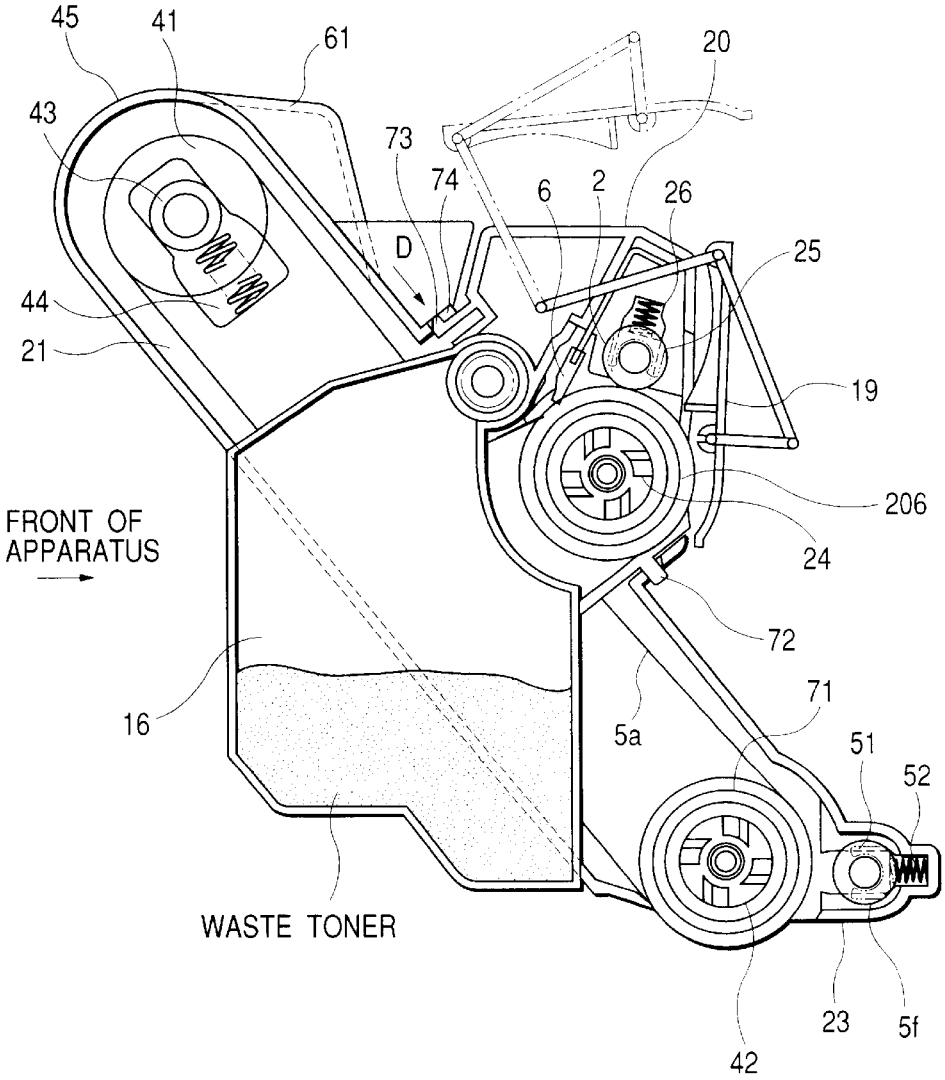
FIG. 3 is a main longitudinal cross-sectional illustration of the image forming unit as it is seen from the right thereof.

FIG. 2 is an enlarged main longitudinal cross-sectional view schematically showing the construction of the image forming unit of FIG. 1, and more particularly is a cross-sectional view of the unit as it is seen from the left of the front of the apparatus. FIG. 3 is a longitudinal cross-sectional view of the image forming unit as it is seen from the right of the front of the apparatus. Also, FIG. 4 is a transverse cross sectional view of the image forming unit of FIG. 2 as it is seen from above it in a waste toner carrying path portion.

Figure 4:
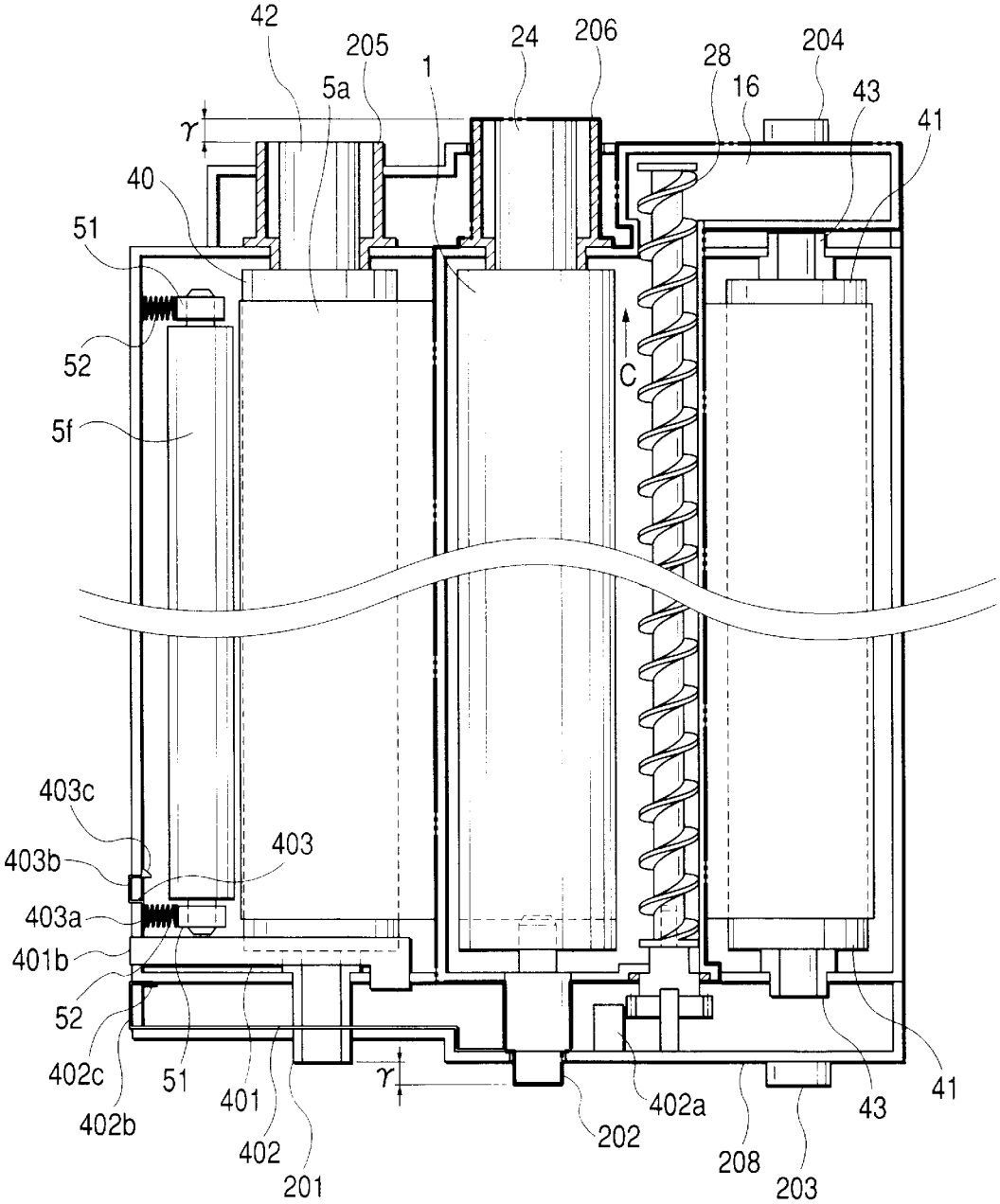
FIG. 4 is a cross-sectional illustration of the image forming unit as it is seen from above it.

In FIGS. 2 to 4, the image forming unit 5 has a photosensitive drum unit 20 disposed on the upper plane of projection of an intermediate transferring belt unit 21, and the waste toner box 16 disposed on the lower plane of projection of the intermediate transferring belt unit 21. Also, the belt driving roller 40 of the intermediate transferring belt unit 21 is provided with a cleaning charging roller portion 23 for inducing predetermined charges in the residual toners on the intermediate transferring belt 5*a,* and they are of an integral construction.

Photosensitive Drum Unit

In the photosensitive drum unit 20, which is a first unit, as shown in FIGS. 2 and 3, the photosensitive drum 1 has its opposite ends rotatably held by a right bearing 206 and a left rotary support shaft 202, and a predetermined rotative driving force is adapted to be transmitted thereto from the main body of the apparatus through a coupling 24 in the right end portion thereof.

Also, the charging roller 2 is adapted to be brought into pressure contact with the photosensitive drum 1 with a predetermined force by a compression spring 26 through bearings 25 at the opposite ends, and be driven to rotate. At least one of the bearings 25 is constituted by an electrically conductive member, and the design of the device is made such that a predetermined charging bias voltage is applied from the compression spring to the charging roller 2 through the bearings 25 to thereby uniformly charge the surface of the photosensitive drum 1.

Figure 5:
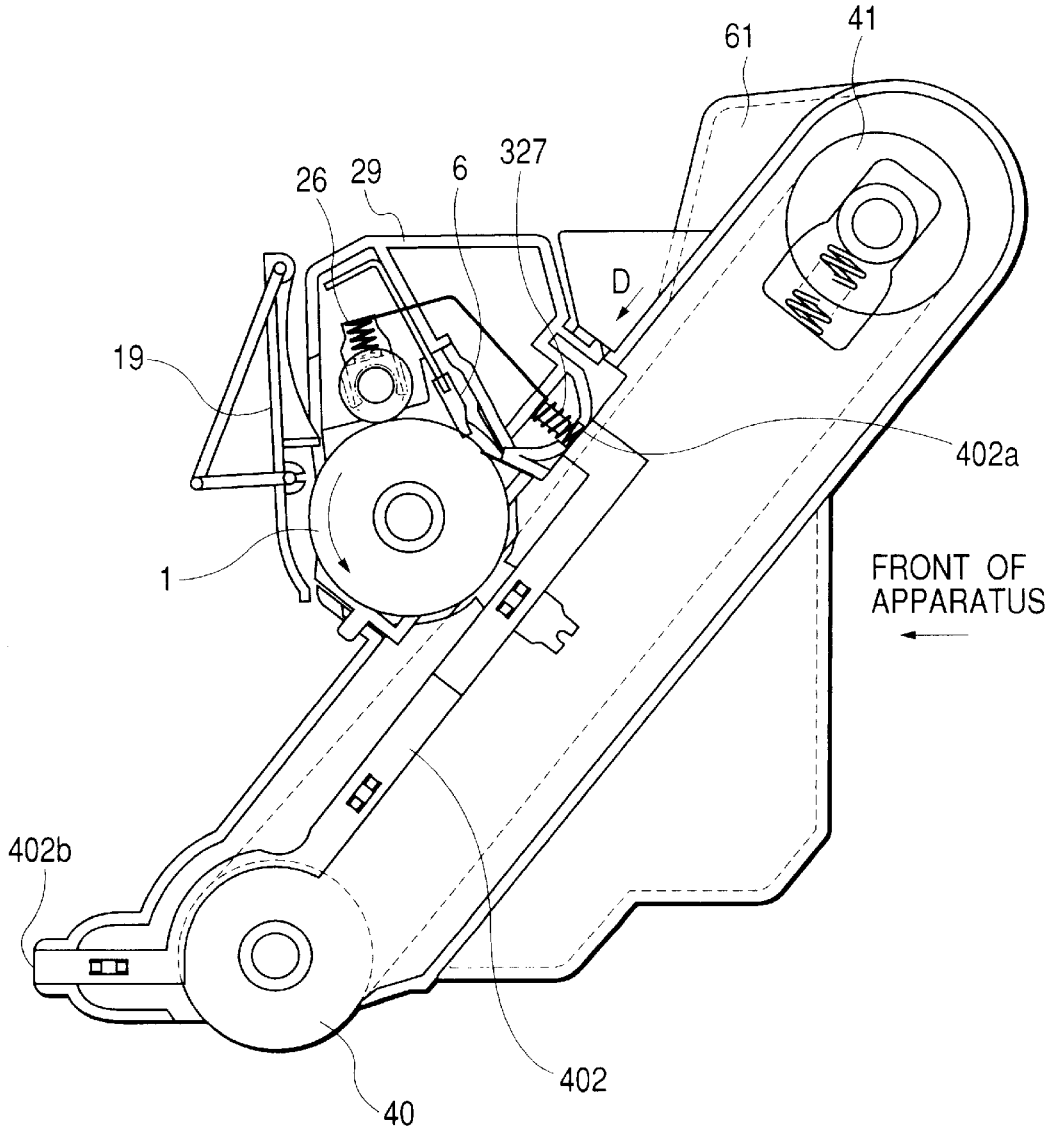
FIG. 5 is a cross-sectional illustration showing a bias voltage supplying path to a charging roller for charging a photosensitive drum.

Further, the end portion of the compression spring 26, as shown in FIG. 5, extends downwardly from the left side of a photosensitive drum frame 29 to provide a compression spring 327, one end of which is forced into and fixed to the boss portion of the photosensitive drum frame 29.

Furthermore, the cleaning blade 6 is provided on the photosensitive drum 1 at a predetermined location, and is designed to collect the residual toners on the intermediate transferring belt in which the aforementioned predetermined charges have been induced onto the photosensitive drum 1, and scrape them off with the residual toners on the photosensitive drum 1. The waste toners thus scraped off are prevented from falling onto the intermediate transferring belt 5*a* by a dip sheet 27 (see FIG. 2), and the waste toners collected on the bottom of the photosensitive drum frame 29 are carried rightwardly as viewed from the front of the apparatus (in the direction of arrow C in FIG. 4) by the rotation of a screw 28.

Thereafter, the waste toners are carried to the right side (as viewed from the front side of the apparatus) of the photosensitive drum unit 20 by the screw 28, and slide into and are accumulated in the waste toner box 16. The photosensitive drum unit 20 is also provided with a drum shutter 19 opened and closed in operative association with the operation of attaching and detaching the photosensitive drum unit to and from the main body of the image forming apparatus.

Intermediate Transferring Belt Unit

The construction of the intermediate transferring belt unit 21, which is a second unit, will now be described. The intermediate transferring belt 5*a* is passed over a frame 45 including a grip portion 61 by means of a driving roller 40 and a driven roller 41.

The driving roller 40 has its opposite ends rotatably held by bearings, not shown, and is designed such that a predetermined rotative driving force is transmitted thereto from the main body of the apparatus through a coupling 42 (see FIG. 3) in the right end portion. Also, compression springs 44 are provided on bearings 43 at the opposite ends of the driven roller 41 so as to give a predetermined tension to the intermediate transferring belt 5*a*.

The primary transferring roller 5*j* is provided at a location opposed to the photosensitive drum 1 with the intermediate transferring belt 5*a* interposed therebetween, and is adapted to be brought into pressure contact with the photosensitive drum with a predetermined force by a compression spring 47 through bearings 46 at the opposite ends thereof, and be driven to rotate.

At least one of the bearings 46 is constituted by an electrically conductive member, and a predetermined charging bias voltage is applied to the primary transferring roller 5*j*, whereby the toners on the surface of the photosensitive drum 1 are primary-transferred onto the intermediate transferring belt 5*a*.

Figure 6:
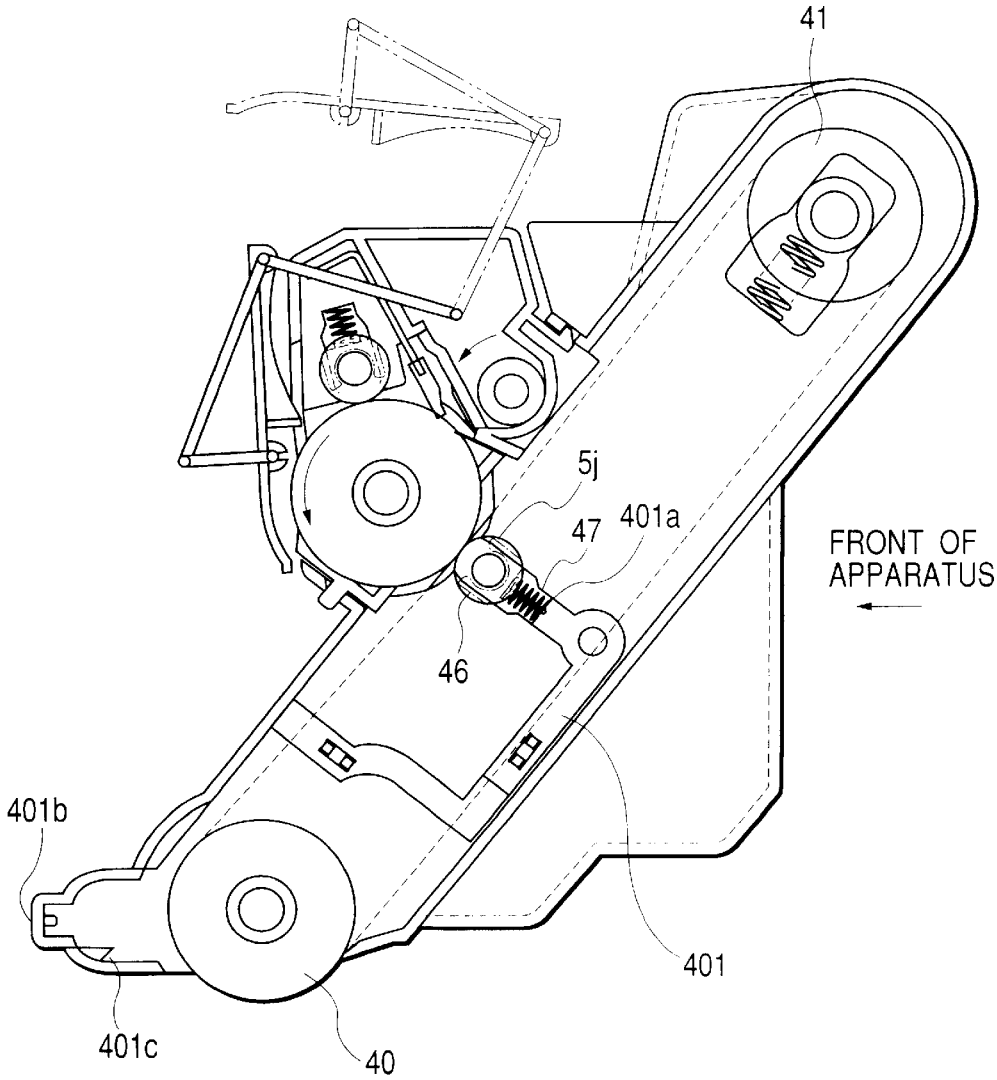
FIG. 6 is a cross-sectional illustration showing a bias voltage supplying path to a primary transferring roller.

As shown in FIG. 6, a primary transferring roller high voltage contact plate 401, which is an electrically conductive member, is provided on the left side of an intermediate transferring body frame 45, and one end portion 401*a* thereof is connected to a compression spring 47, and the other end portion (electrical contact means for transfer) 401*b* thereof is fixed to the left lower portion of the intermediate transferring body frame 45 by a hook portion 401*c*.

Also, as shown in FIG. 2, a cleaning charging roller portion 23 for inducing predetermined charges in the residual toners on the intermediate transferring belt is provided at a location opposed to the intermediate transferring belt driving roller 40.

The cleaning charging roller 5*f* is adapted to be brought into pressure contact with the driving roller 40 with a predetermined pressure by a compression spring 52 through bearings 51 at the opposite ends thereof, and to be driven to rotate. At least one of the bearings 51 is constituted by an electrically conductive member, and a predetermined voltage is applied to the cleaning charging roller 5*f* to thereby induce predetermined charges in the residual toners on the intermediate transferring belt 5*a*, and the residual toners are electrostatically attracted to the surface of the photosensitive drum 1, and are collected and accumulated in the waste toner box 16 as previously described.

Also, as shown in FIG. 4, the compression spring 52 is connected to one end portion 403*a* of a cleaning charging roller high voltage contact plate 403 constituting cleaning means, and the other end portion (electrical contact means for cleaning) 403*b* thereof is fixed to the left lower portion of the intermediate transferring body frame 45 by a hook portion 403*c*.

Further, as shown in FIGS. 4 and 5, a charging roller high voltage contact plate 402, which is an electrically conductive member for supplying a high voltage to the charging roller 2, is provided on the inner side of the left cover 208 of the intermediate transferring body frame 45, and one end portion (second electrical contact means) 402*a* thereof is fixed to the upper surface of the intermediate transferring body frame 45, and is connected to a compression spring (first electrical contact means) 327 downwardly extending from the left side of the aforedescribed photosensitive drum frame 29, and the other end portion (electrical contact means for charging) 402*b* thereof is fixed to the left lower portion of the intermediate transferring body frame 45 by a hook portion 402*c*. As a result, thereby, electric power from the main body of the apparatus is supplied to one end portion 402*b* of the charging roller high voltage contact plate 402, and is supplied to the charging roller 2 through the compression spring 26 and the bearings 25 because the other end portion 402*a* of the contact plate 402 and the compression spring 327 are electrically connected together as electrical contact means.

As described above, the supply contact portions for the bias voltages from the main body of the image forming apparatus to (1) the charging roller 2, (2) the primary transferring roller 5*j* and (3) the cleaning means are concentrated in the lower portions 402*b*, 401*b* and 403*b* of the left side (outside the width of the image forming area) of the intermediate transferring belt unit 21. One of the first unit and the second unit is supplied with electric power through the other unit. That is, the charging roller in the photosensitive drum unit is supplied with electric power from the power source on the main body side of the apparatus through the charging roller high voltage contact plate in the intermediate transferring belt unit.

As a result, the supply of electric power from the power source on the main body side of the apparatus to the image forming unit can be effected from only a certain particular portion of the image forming unit, and a cable or the like drawn around on the main body side of the apparatus can be simplified.

Unit Construction of the Image forming Unit

The frame construction of the image forming unit 5 will now be described in detail. The frame construction is broadly divided into two. The first unit, as shown in FIGS. 3 and 4, is the photosensitive drum unit 20 (the portion encircled by thick dots-and-dash line in FIG. 4) comprising the photosensitive drum frame 29 assuming a construction integral with the waste toner box 16, and in addition, the photosensitive drum 1, the right bearing 206, the left rotary support shaft 202, the charging roller 2, the cleaning blade 6, the screw 28 and the drum shutter 19 serve as main parts. Also, the second unit, as shown in FIG. 2, is the intermediate transferring belt unit 21 comprising the intermediate transferring belt 5*b* passed over the intermediate transferring body frame 45 by means of the intermediate transferring belt roller 40 and the driven roller 41, and the primary transferring roller 5*j* disposed on the inner side of the intermediate transferring belt, which is opposed to the photosensitive drum 1, and the cleaning charging roller 5*f* disposed for the driving roller 40.

The above-described two units, as shown in FIGS. 2 and 3, are connected together with projected portions 71 provided on the right and left ends of the photosensitive drum frame 29 being inserted in positioning holes 72 formed in the intermediate transferring body frame 45, and on the other hand, with the claw 73 of a hook portion of a snap fit type provided at the widthwise center of the photosensitive drum frame 29 being fitted in the lock hole 74 of the intermediate transferring body frame 45.

The positioning holes 72 and the lock hole 74 formed in the intermediate transferring body frame 45 are larger by a predetermined amount than the projected portions 71 and the claw 73 of the hook portion, respectively, provided on the photosensitive drum frame 29, and a predetermined amount of relative position movement is possible between the photosensitive drum unit 20 and the intermediate transferring belt unit 21. Also, the positioning holes 72 are provided with tapered portions 72*a* (see FIG. 8) so as to facilitate the attachment and detachment of the units.

Figure 7:
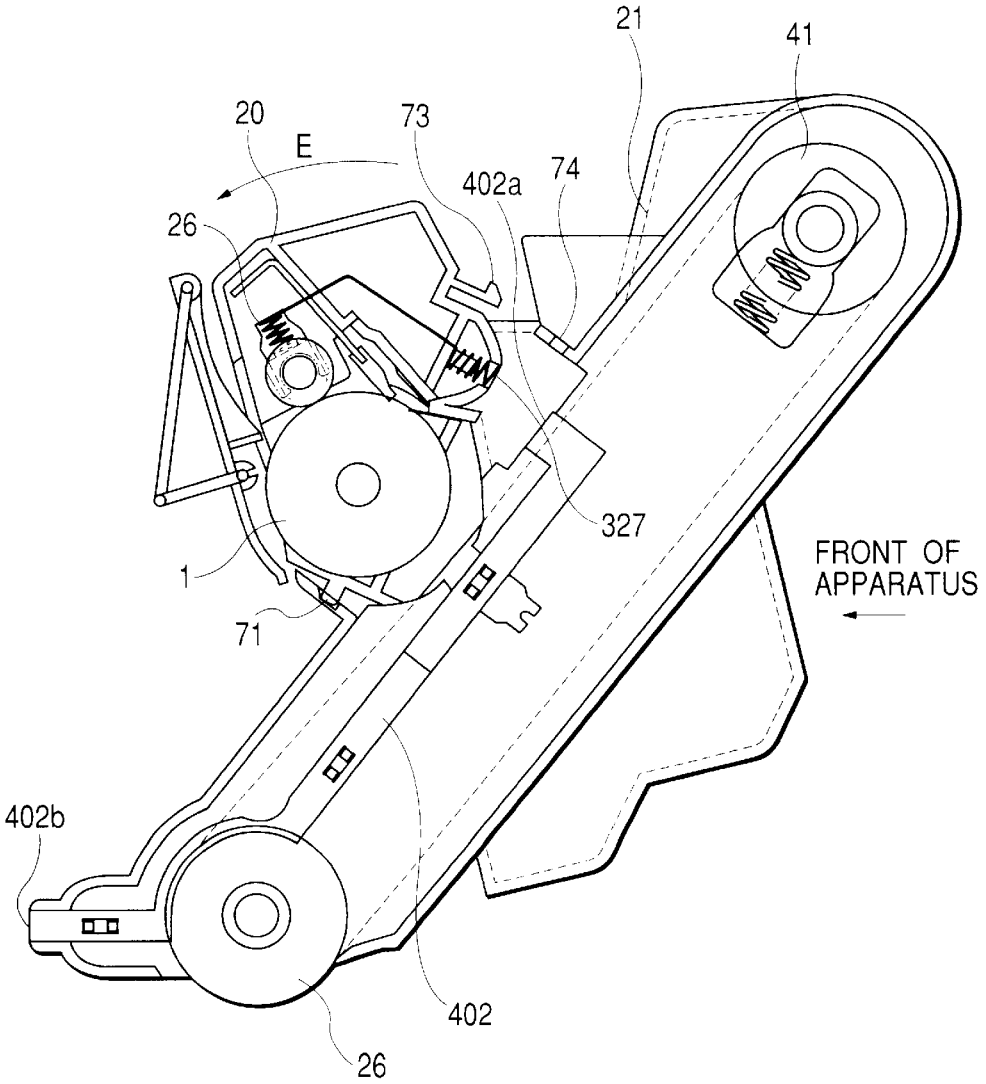
FIG. 7 is an illustration showing the situation of a high voltage contact portion when a photosensitive body unit and an intermediate transferring body unit are divided.
Figure 8:
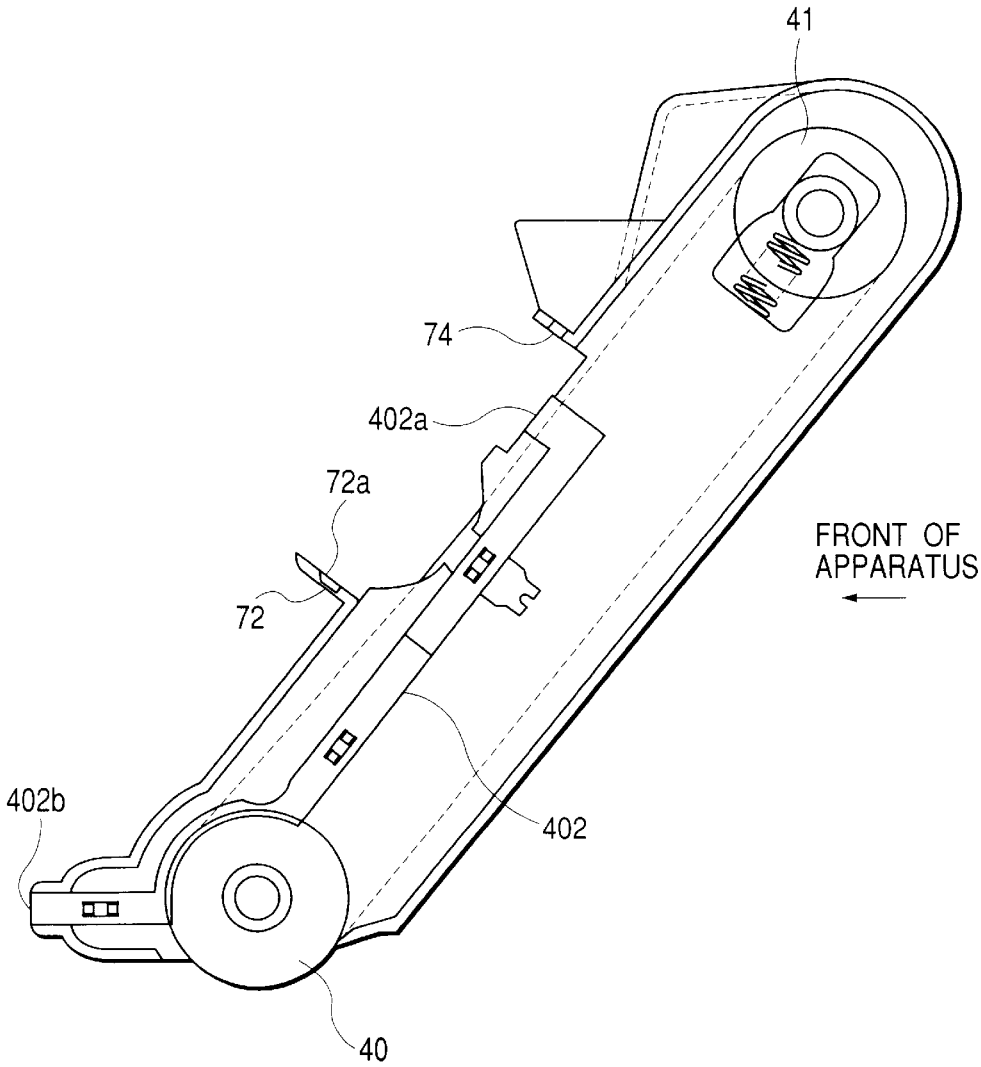
FIG. 8 is an illustration of the intermediate transferring body unit.
Figure 9:
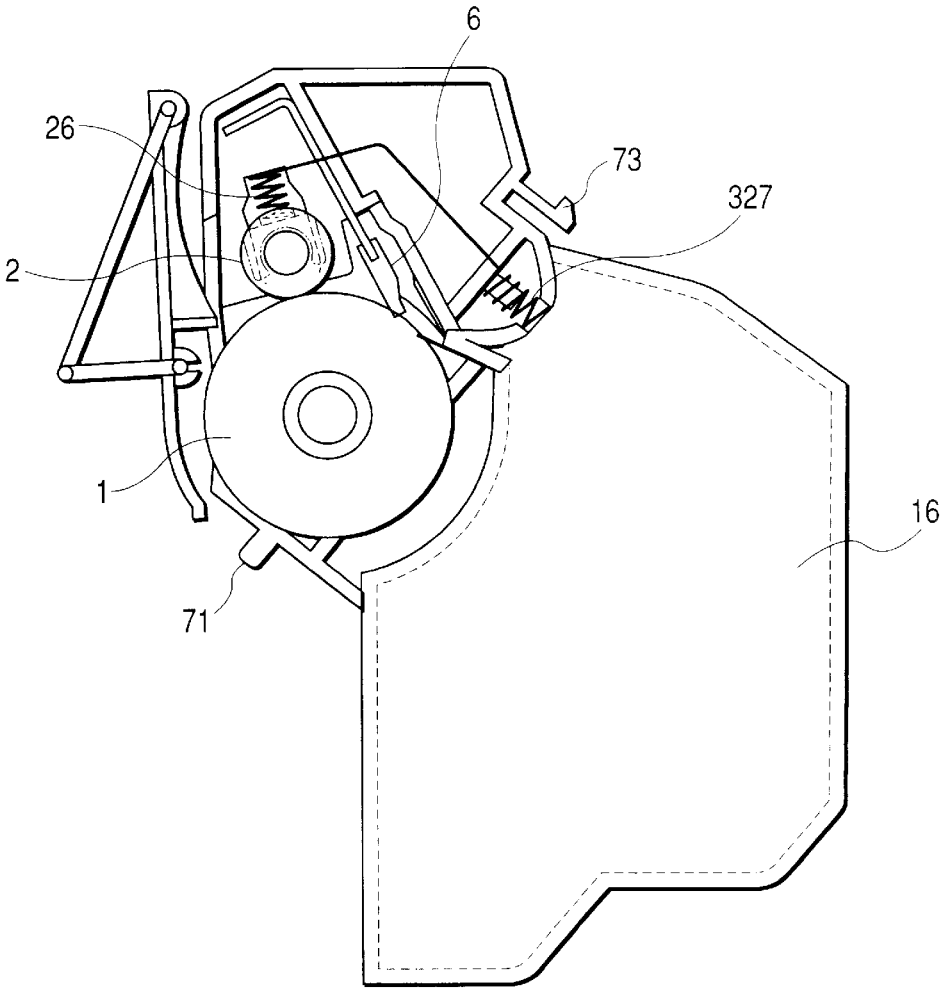
FIG. 9 is an illustration of the photosensitive body unit.

In the above-described construction, as shown in FIG. 3, the hook claw 73 of the photosensitive drum unit 20 is pushed in the direction of arrow D to thereby disengage it from the lock hole 74 of the intermediate transferring belt unit 21, and as shown in FIG. 7, the photosensitive drum unit 20 is rotated in the direction of arrow E, whereby as shown in FIGS. 8 and 9, the construction can be divided into the photosensitive drum unit 20 and the intermediate transferring belt unit 21.

When the separated two units 20 and 21 are to be connected together, conversely to what has been described above, the projected portions 71 of the photosensitive drum unit 20 are inserted into the positioning holes 72 of the intermediate transferring belt unit 21, and the photosensitive drum unit 20 is rotated in a direction opposite to the direction of arrow E in FIG. 7 and the hook claw 73 is pushed into the lock hole 74, whereby the two units 20 and 21 are connected together.

At this time, the bias voltage supplying path to the charging roller 2 is designed to be connected to and separated from the end portion 402*a* of the charging roller high voltage contact plate 402 provided on the intermediate transferring belt unit 21 side by a compression spring 327 provided on the photosensitive drum unit 20 side.

As previously described, the photosensitive drum unit 20 and the intermediate transferring belt unit 21 are separable from each other and therefore, when only the photosensitive drum 1 or only the intermediate transferring belt 5*a* has reached the end of its life, it becomes possible to interchange only the unit which has reached the end of its life. Therefore, the user's cost load is mitigated when the lives of the photosensitive drum 1 and the intermediate transferring belt 5*a* differ from each other.

Means for Mounting the Unit to the Main Body of the Apparatus

Figure 10:
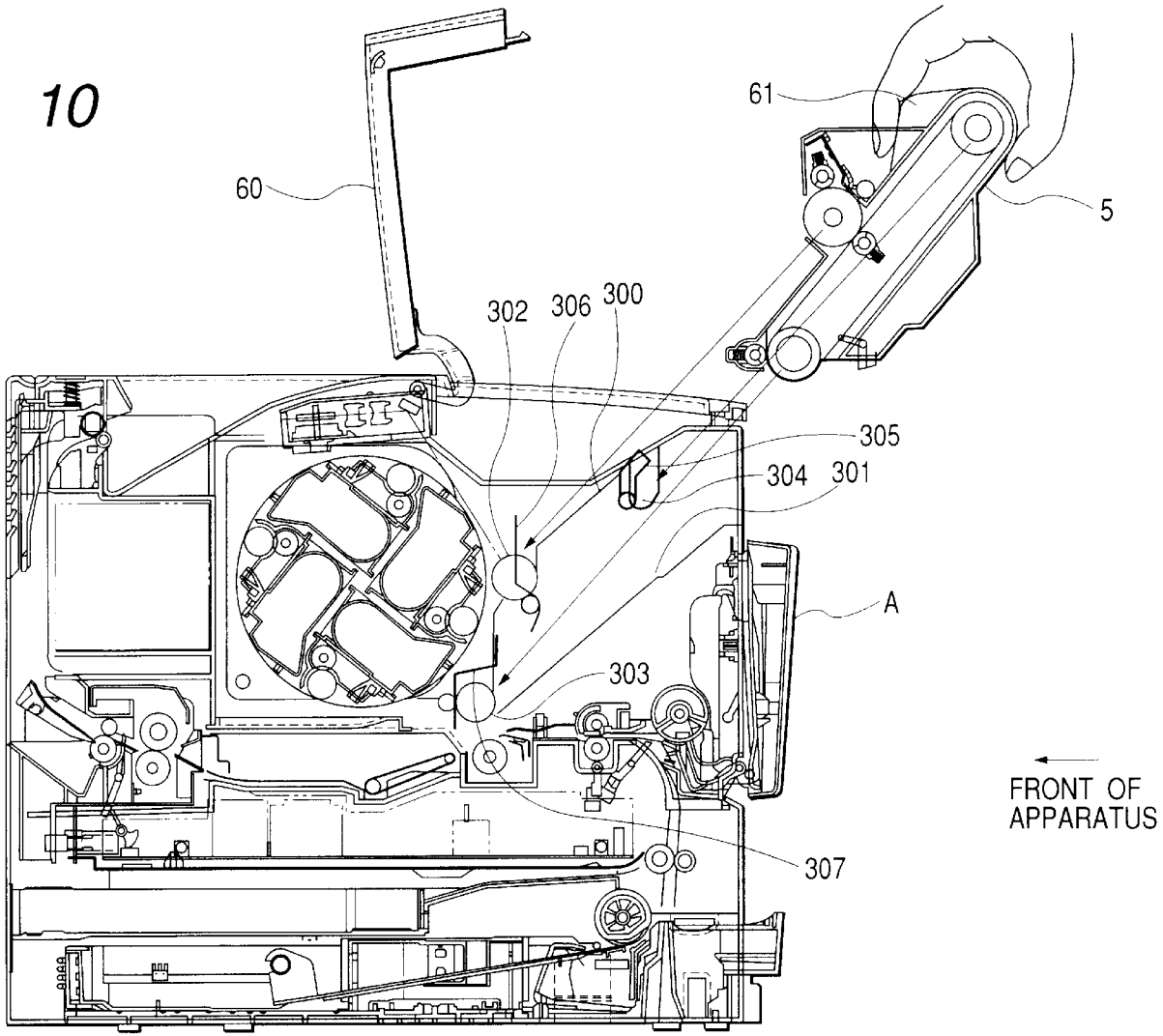
FIG. 10 is an illustration showing a state in which an image forming unit is detachably attached to the main body of the apparatus.

Reference is now had to FIG. 10 to describe a construction for mounting and dismounting the image forming unit 5 to and from the main body A of the image forming apparatus and positioning and fixing it at a predetermined position.

When the upper lid 60 of the main body A of the color image forming apparatus is opened, a coupling fitted to a coupling 24 (see FIG. 3) provided on a supporting portion 302 for supporting the bearings of the photosensitive drum, and transmitting a rotative driving force to the photosensitive drum 1, and a coupling, fitted to a coupling 42 (see FIG. 3) provided on a supporting portion 303 for supporting the bearing portion of the intermediate transferring belt driving portion, and transmitting a rotative driving force to the intermediate transferring belt driving roller slide in the axial direction thereof, become retracted (disconnected). A conventional construction can be used as the retracting construction itself of the couplings operatively associated with the appear lid 60.

A guide rail 300 for the photosensitive drum and a guide rail 301 for the intermediate transferring body are provided on both sides inside the main body of the apparatus with a level difference γ provided therebetween. This level difference γ is the level difference γ between the bearing 206 and the rotary support shaft 202 for the drum of the image forming unit and the bearings 201, 205 of the intermediate transferring belt driving roller, as shown in FIG. 4.

The right bearing 206 and left rotary support shaft 202 of the photosensitive drum of the image forming unit 5, and the right bearing 205 and left bearing 201 of the intermediate transferring belt driving roller and projected portions 203 and 204 (see FIG. 4) provided on left and right side covers are inserted while being placed and slid on the guide rail 300 for the photosensitive drum and the guide rail 301 for the intermediate transferring body, respectively.

Finally, the right bearing 206 and left rotary support shaft 202 of the photosensitive drum fall onto the supporting portion 302 supporting the bearing of the photosensitive drum, and the right bearing 205 and left bearing 201 of the intermediate transferring belt driving roller fall onto the supporting portion 303 supporting the bearing portion of the intermediate transferring belt driving shaft and further, the projected portions 203 and 204 provided on the left and right side covers of the image forming unit fall into positioning grooves 304, and as shown in FIG. 10, they are urged against and fixed to the apparatus main body frame by torsion coil springs 305, 306 and 307, respectively.

Figure 11:
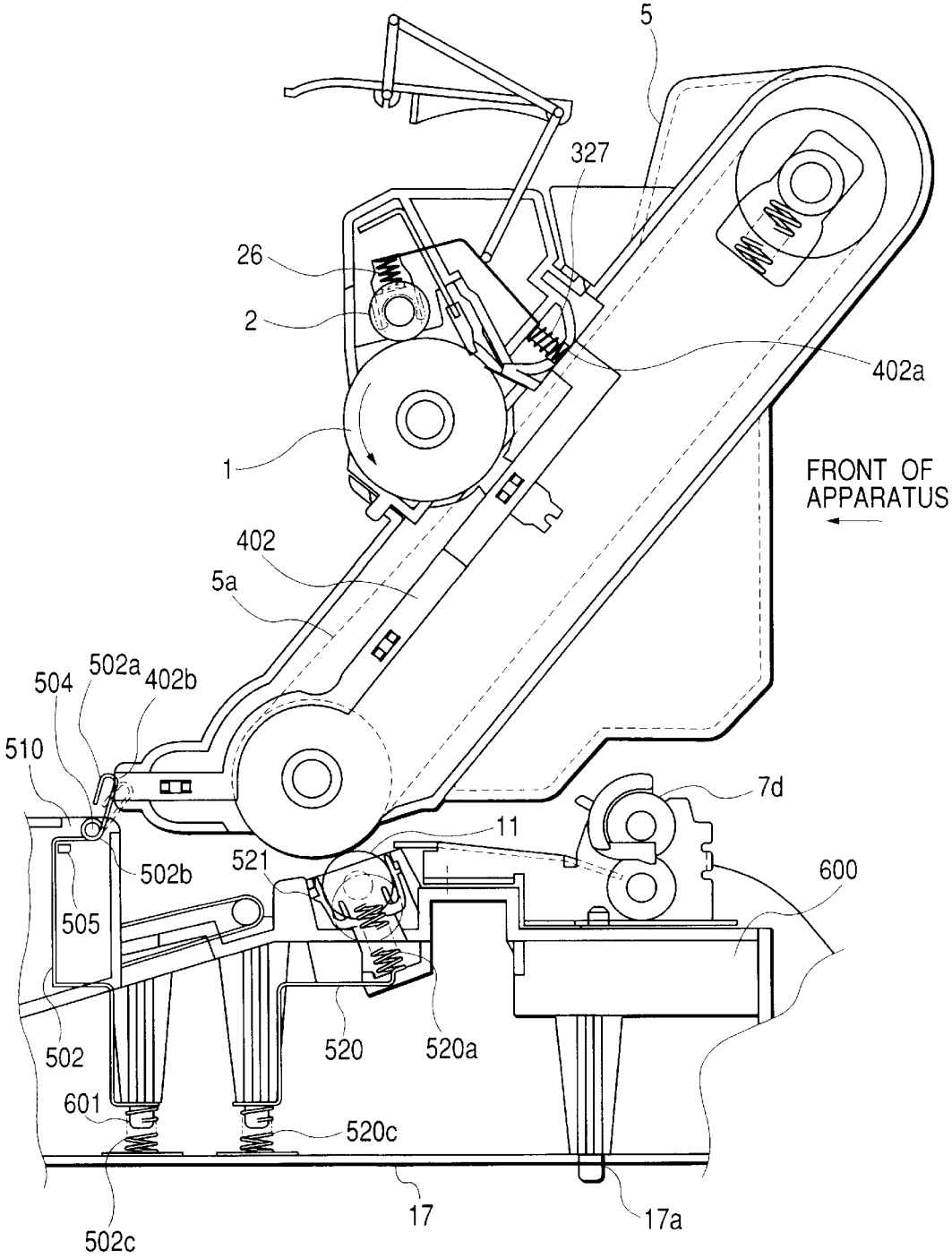
FIG. 11 is a cross-sectional illustration showing the high voltage contact portions of the image forming unit and the main body of the apparatus.
Figure 12:
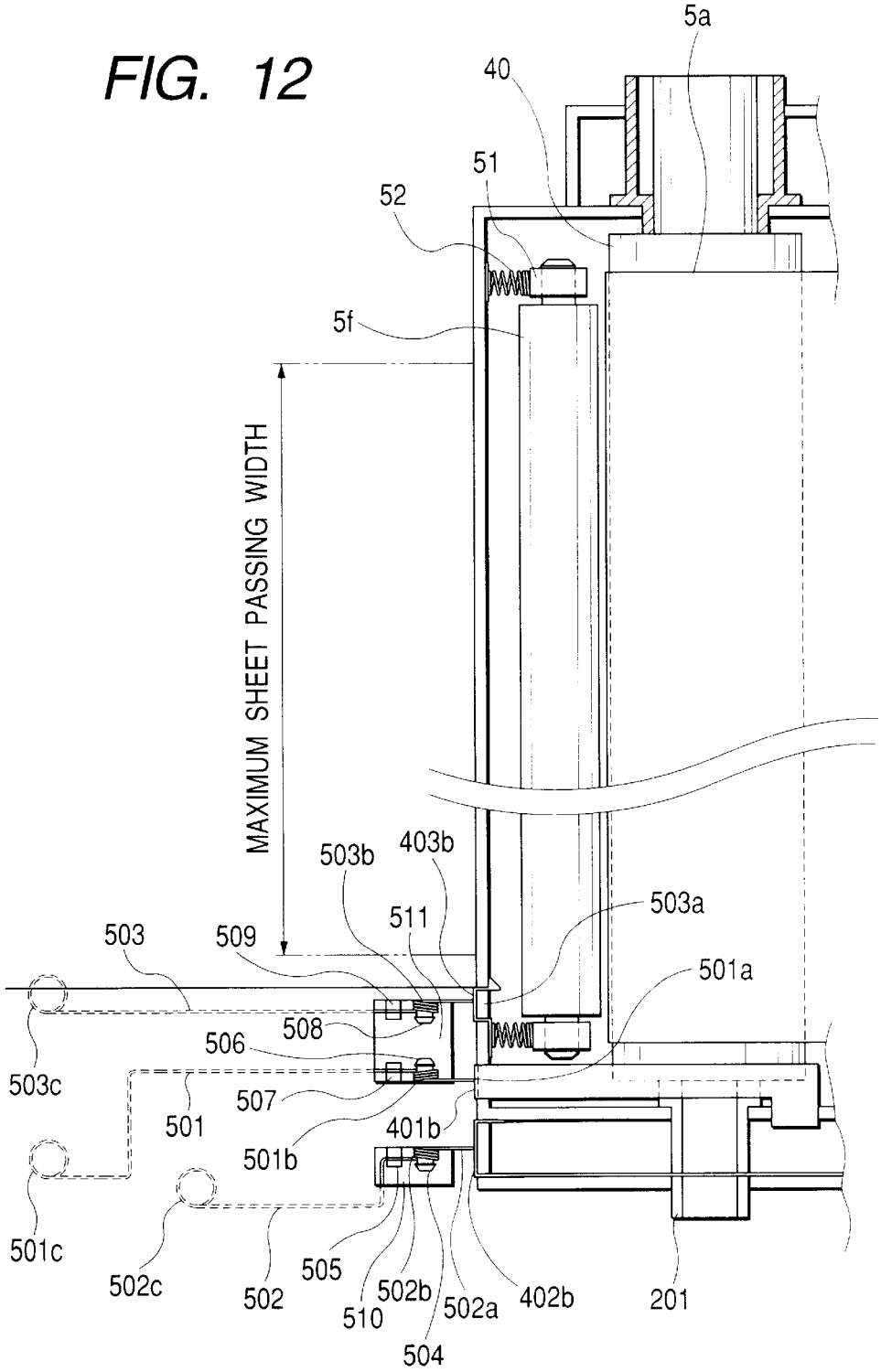
FIG. 12 is a top plan illustration showing the high voltage contact portions of the image forming unit and the main body of the apparatus.

In this state, as shown in FIGS. 11 and 12, (1) the high voltage contact portion 402*b* for supplying a bias voltage to the charging roller 2 for uniformly charging the photosensitive drum 1, (2) the high voltage contact portion 401*b* for supplying a bias voltage to the primary transferring roller 5*j* for transferring the toner images on the photosensitive drum 1 to the intermediate transferring belt 5*a,* and (3) the high voltage contact portion 403*b* for supplying a bias voltage to the cleaning charging roller 5*f* for inducing predetermined charges in the residual toners on the intermediate transferring belt, on the image forming unit 5 side, are in contact with the end portions 502*a,* 501*a* and 503*a* of the high voltage supplying contact springs 502, 501 and 503, respectively, provided on the main body side of the image forming apparatus with a predetermined pressure force.

The high voltage contact spring 502 of the main body side of the image forming apparatus for supplying a bias voltage to the charging roller 2 is constituted by only a coil spring, and the torsion coil spring portion 502 thereof is adapted not to slip out by the thick shaft shape of the tip end portion thereof (the diameter of the root of a boss< the inner diameter of the coil spring< the diameter of the tip end of the boss), as shown in FIG. 12, after it is widened and pushed into the boss portion 504 of an apparatus main body frame 600.

One arm 502*a* of the torsion coil spring has its tip end portion bent as shown in FIG. 12, and protrudes out of a hole 510 formed in the apparatus main body frame 600. The other arm of the torsion coil spring 502 is prevented from rotating by the projected portion 505 of the apparatus main body frame 600, and the end portion thereof becomes a compression spring portion 502*c* and is forced into the tip end 601 of the boss portion downwardly extending from the apparatus main body frame 600.

Each of the high voltage contact 501 of the main body side of the image forming apparatus for supplying a bias voltage to the primary transferring roller 5*j* and the high voltage contact 503 of the main body side of the image forming apparatus for supplying a bias voltage to the cleaning charging roller 5*f,* like the high voltage contact spring 502, is also constituted by only a coil spring, and the coil spring portions 501*b* and 503*b* thereof are adapted not to slip out by the thick shaft shape of the tip end portions thereof (the diameter of the root of a boss< the inner diameter of the coil spring< the diameter of the tip end of the boss), as shown in FIG. 11, after they are widened and pushed into the boss portions 506 and 508, respectively, of the apparatus body frame 600.

One arm 501*a* of the torsion coil 501 spring and one arm 503*a* of the torsion coil 503 spring also have their tip end portions likewise bent as shown in FIG. 12, and each of them protrudes out of a hole 511 formed in the apparatus main body frame 600.

The other arms of the torsion coil springs 501 and 503 are likewise prevented from rotating by the projected portions 507 and 509, respectively, of the apparatus main body frame 600, and the end portions thereof become compression spring portions 501*c* and 503*c,* respectively, and are likewise forced into the tip ends of boss portions downwardly extending from the apparatus main body frame 600.

Thus, a high voltage source substrate 17 is attached from below along positioning bosses 17*a* at at least two locations as shown in FIG. 12 and fixed by screws, whereby the high voltage contact compression spring portions 502*c,* 501*c* and 503*c* of (1) the high voltage supplying contact spring 502 for supplying a bias voltage to the charging roller 2 for uniformly charging the photosensitive drum 1, (2) the high voltage supplying contact spring 501 for supplying a bias voltage to the primary transferring roller 5*j* for transferring the toner images on the photosensitive drum 1 to the intermediate transferring belt 5*a,* and (3) the high voltage supplying contact spring 503 for supplying a bias voltage to the cleaning charging roller 5*f* for inducing predetermined charges in the residual toners on the intermediate transferring belt and each bias voltage supplying portion of the high voltage source substrate are connected together with predetermined pressure.

Also, as shown in FIG. 11, on the image forming unit 5 side and the main body side of the image forming apparatus, the arms of the respective torsion coil spring contacts are deformed from the position of the dots-and-dash line to the position of a solid line, and are connected together with predetermined pressure (in FIG. 11, the high voltage supplying contact spring 502 is shown by way of example).

On the other hand, at least one of the bearings 521 of the secondary transferring roller 11 is likewise formed by an electrically conductive member, and this roller 11 is supplied with a secondary transferring bias voltage through compression spring portions 520*a* and 520*c* provided at the opposite ends of a coil spring 520.

Next, when the image forming unit 5 is to be detached, the contact means being in pressure contact with each other by a spring can be spaced apart from each other simply by opening the upper lid 60 and drawing out the image forming unit 5, which can thus be drawn out easily. After the image forming unit 5 has been taken out, as is apparent also from FIG. 10, the transferring material conveying path is exposed from above it. Therefore, even when the transferring material is jammed, jam treatment can be done easily.

While in the aforedescribed embodiment, there has been shown an example in which the photosensitive drum unit 20 and the intermediate transferring belt unit 21 are connected together to thereby constitute an image forming unit, the photosensitive drum unit 20 may be integrally fixed to a unit housing to thereby constitute it as a unit usable also in an ordinary image forming apparatus, and the intermediate transferring belt unit 21 may be constructed detachably attachably to this unit housing to thereby construct an image forming unit used in the image forming apparatus of the present invention. Even when only the intermediate transferring belt unit 21 is thus made detachably attachable, when the intermediate transferring belt unit 21 is taken out, the transferring material conveying path is exposed and jam treatment can be done easily.

Also, conversely to what has been previously described, the intermediate transferring belt unit 21 may be integrally fixed to the unit housing, and the photosensitive drum unit 20 may be constructed detachably attachably to this unit housing.

Also, while in the aforedescribed embodiment, there has been shown an example in which the primary transferring roller high voltage contact plate 401, the charging roller high voltage contact plate 402 and the cleaning charging roller high voltage contact plate 403 are provided in the intermediate transferring belt unit 21, these may be provided on the photosensitive drum unit 20 side.

Also, while in the aforedescribed embodiment, there has been shown an image forming unit provided with the cleaning charging roller 5*f,* the image forming unit need not be provided with the cleaning charging roller 5*f* as cleaning means. Accordingly, in this case, it is not necessary to provide the cleaning charging roller high voltage contact plate 403.

The present invention, as previously described, is designed such that in the image forming unit detachably attachable to the main body of the image forming apparatus, provision is made of electrical contact means for connecting the photosensitive drum unit 20 having the photosensitive drum 1 and the intermediate transferring belt unit 21 having the intermediate transferring belt 5*a* together and therefore, it becomes possible to separate the photosensitive drum unit 20 and the intermediate transferring belt unit 21 from each other. Therefore, only the unit which has reached the end of its life can be interchanged, and this leads to the excellence in cost performance.

Also, an electrical contact is provided between the units, and a bias voltage from the main body of the apparatus is supplied to only one of the units, and the other unit receives the supply of the bias voltage through the aforementioned unit, whereby the wiring of a high voltage cable in the main body of the apparatus can be simplified.

As regards the contact, there are conceivable both of a case where the high voltage contact is present between units of an integral construction constructed separably from each other and a case where the high voltage contact is present between units originally constructed independently of each other.

Also, the design of the device is made such that the transferring material conveying path is exposed with the image forming unit 5 detached from the main body of the image forming apparatus and therefore, it becomes possible to effect jam treatment easily.

Also, the electrical contact means of the main body side of the apparatus electrically connected to the electrical contact means provided in the image forming unit 5 has its end portion adjacent to the image forming unit constituted by a torsion coil spring portion and has its end portion adjacent to the contact portion of the power source circuit substrate side constituted by a compression coil spring and therefore, simply by attaching the power source circuit substrate from below, high voltage wiring and connection can be completed and the assembling property is greatly improved and also, a reduction in cost can be achieved.

Also, by the high voltage source substrate 17 being disposed on the lower side of projection of the transferring material conveying path, the high voltage supplying path is simplified and the downsizing of the entire apparatus becomes possible.

Since the present embodiment is designed such that as previously described, the first unit and the second unit are provided with electrical contact means for supplying electric power from one of them to the other, a high voltage cable or the like becomes unnecessary when electrically connecting the power source substrate of the main body of the image forming apparatus and the image forming unit together, and it becomes possible to separate the first unit and the second unit from each other. Therefore, only the unit which has reached the end of its life can be interchanged, and this leads to the excellent cost performance.

Figure 21:
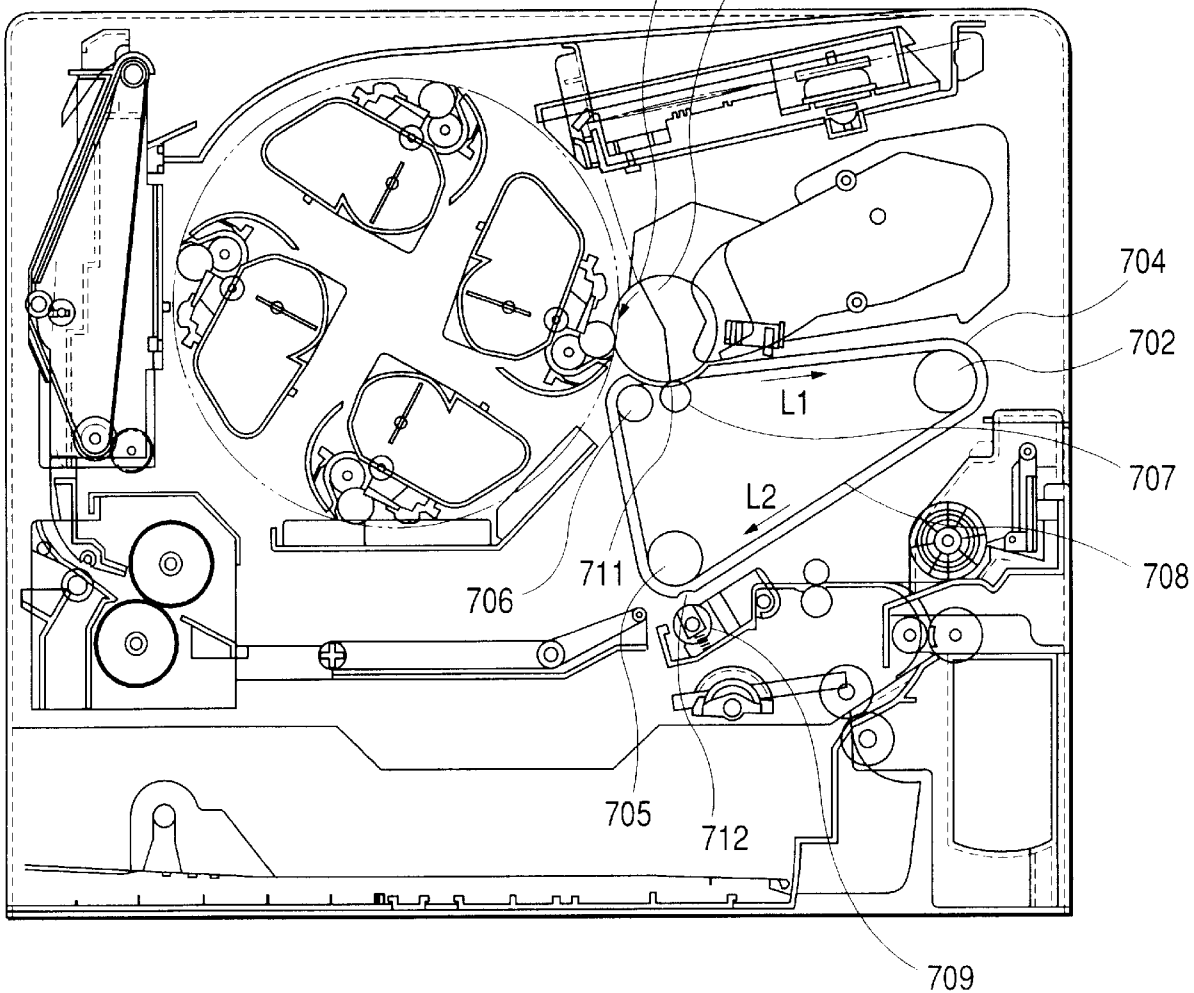
FIG. 21 is an illustration of an image forming apparatus according to the conventional art.

Now, FIG. 21 is an illustration of a color image forming apparatus according to the conventional art using an intermediate transferring belt. In FIG. 21, an intermediate transferring unit 704 comprises an intermediate transferring belt 708 passed over three rollers, i.e., a driving roller 702, a secondary transferring opposed roller 705 and a tension roller 706 for imparting predetermined tension to the intermediate transferring belt 708 by a spring, not shown, and a primary transferring roller 707 provided at a location opposed to a photosensitive drum 701.

The driving roller 702, as shown in FIG. 21, is rotated in the rightward direction (clockwise direction) and the intermediate transferring belt 708 is also rotatively moved rightwardly as indicated by arrow. The secondary transferring opposed roller 705 and the tension roller 706 are designed to be driven to rotate by the intermediate transferring belt 708.

The photosensitive drum 701 of a photosensitive drum cartridge 703, as shown in FIG. 21, is disposed at L1 between the intermediate transferring belt driving roller 702 and the tension roller 706, and the primary transferring roller 707 is disposed in opposed relationship therewith with the intermediate transferring belt 708 interposed therebetween.

L1, which is a primary transferring region, is present is the upstream side with respect to the conveying direction of the intermediate transferring belt as viewed from the direction of rotation of the intermediate transferring belt driving roller 702, i.e., the so-called tension side of the belt.

This is an arrangement taking into account that the unevenness of the rotative moving speed of the intermediate transferring belt 708 is more stable on the tension side L1 of the belt than on the laxation side L2 of the intermediate transferring belt 708.

That is, the conveying speed of the intermediate transferring belt 708 must be stable in order to reduce the color registration error of each color toner when the steps of developing an electrostatic latent image formed on the photosensitive drum 701 with any color toner, and primary-transferring the thus obtained toner image to the rotating intermediate transferring belt 708 are repeated for each of different colors, whereby superimposed color toner images are formed on the intermediate transferring belt 708.

Further, the circumferential length Lb of the intermediate transferring belt 708 is designed to be substantially an integer times as great as the circumferential length Ld of the photosensitive drum 701 and be also substantially an integer times as great as the circumferential length Lr of the intermediate transferring roller driving roller 702, and the design of the device is such that the variation in the peripheral speed of one revolution period by the vibration of the photosensitive drum 701 and the variation in the conveying speed by the vibration of the driving roller 702 for the intermediate transferring belt 708 are defined as a constant period, and each color toner starts to be primary-transferred from a predetermined position on the intermediate transferring belt 708, whereby the phases of the color registration errors of respective color toners overlap one another on the intermediate transferring belt 708, and the color toner images are collectively transferred to a transferring material by a secondary transferring roller 709 to thereby obtain a color image having a small color registration error.

If FIG. 21, it is to be understood that the diameter D1 of the photosensitive drum 701 is 47 mm, the circumferential length Ld of the photosensitive drum is Ld=47 ρmm and the circumferential length Ld1 of the photosensitive drum 701 from the exposed position 710 thereof to the primary transferring position 711 is about 63 mm.

The circumferential length Lb of the intermediate transferring belt 708 is 47 π=2≅295.3 mm or 47 π3≅442.96 mm, but if the transferring material is a sheet of A4 size, the belt length of at least 360 mm, i.e. the sheet length 297 mm plus the distance 63 mm by which the exposed position 710 of the photosensitive drum 701 comes round to the primary transferring position 711, becomes necessary.

Further, a belt length from the primary transferring position 711 of the intermediate transferring belt 708 to a secondary transferring position 712 in the belt conveying direction, of at least 297 mm, which is the length of the sheet of A4 size, is necessary.

Taking into account the times for the changeover of the respective color developing devices, and the pressurization, spacing apart, etc. of the toner developing devices with respect to the photosensitive drum 701, and estimating the moderate interval (between sheets) at which the sheets are conveyed, the circumferential length Lb of the intermediate transferring belt 708 is properly 442.96 mm.

Also, the circumferential length Lr of the intermediate transferring belt driving roller 702 is 442.96/5≅88.593 mm, and the diameter D2 of the driving roller is 88.893/π≅28.2 mm.

The above-described example of the conventional art has suffered from the following problems. The region at which primary transfer is effected lies on the tension side of the intermediate transferring belt 708, and the position at which secondary transfer is effected and the conveying path of the transferring material must be taken into account and further, a shape in which the aforedescribed dimensional relations are satisfied must be devised and yet the intermediate transferring belt 708 is compactly extended.

However, the intermediate transferring belt 708 has been of a shape in which it is passed over three or more rollers, such as the driving roller 702, the secondary transferring opposed roller 705 opposed to the secondary transferring roller 709 and cooperating with the secondary transferring roller 709 to form a nip and conveying the transferring material, and the tension roller 706 for imparting predetermined tension to the intermediate transferring belt 708. When charging means for charging the toners transferred to the intermediate transferring belt 708 is to be brought into contact with the belt 708, it has been necessary to provide a belt supporting roller at a location opposed to this charging means.

Therefore, a number of rollers high in dimensional accuracy have become necessary for the intermediate transferring belt 708, and a frame itself constituting the intermediate transferring belt unit needs to be complicated and high in accuracy, and this has led to the bulkiness and an increased cost of the intermediate transferring unit and the main body of the image forming apparatus.

A description will now be provided of an embodiment of the present invention which solves the above-noted problems.

This embodiment is similar in construction to the above-described image forming apparatus of FIG. 1 and the different portions thereof will hereinafter be described.

Image Forming Unit

The construction of an image forming unit of an integral construction of a photosensitive drum and an intermediate transferring belt, which is detachably attached to the image forming apparatus of the present embodiment, will hereinafter be described in detail.

Figure 13:
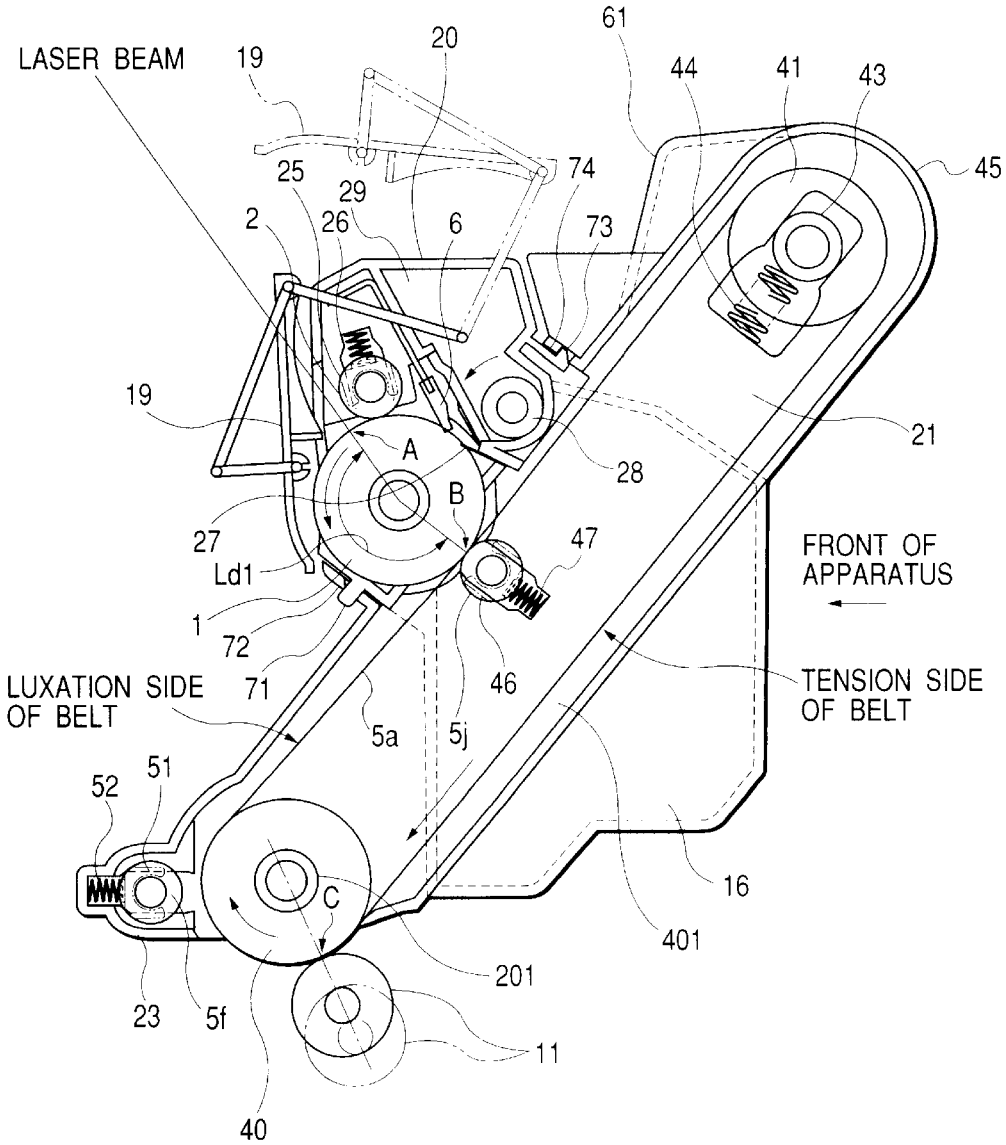
FIG. 13 is a left main longitudinal cross-sectional illustration of an image forming unit which is another embodiment of the present invention.
Figure 14:
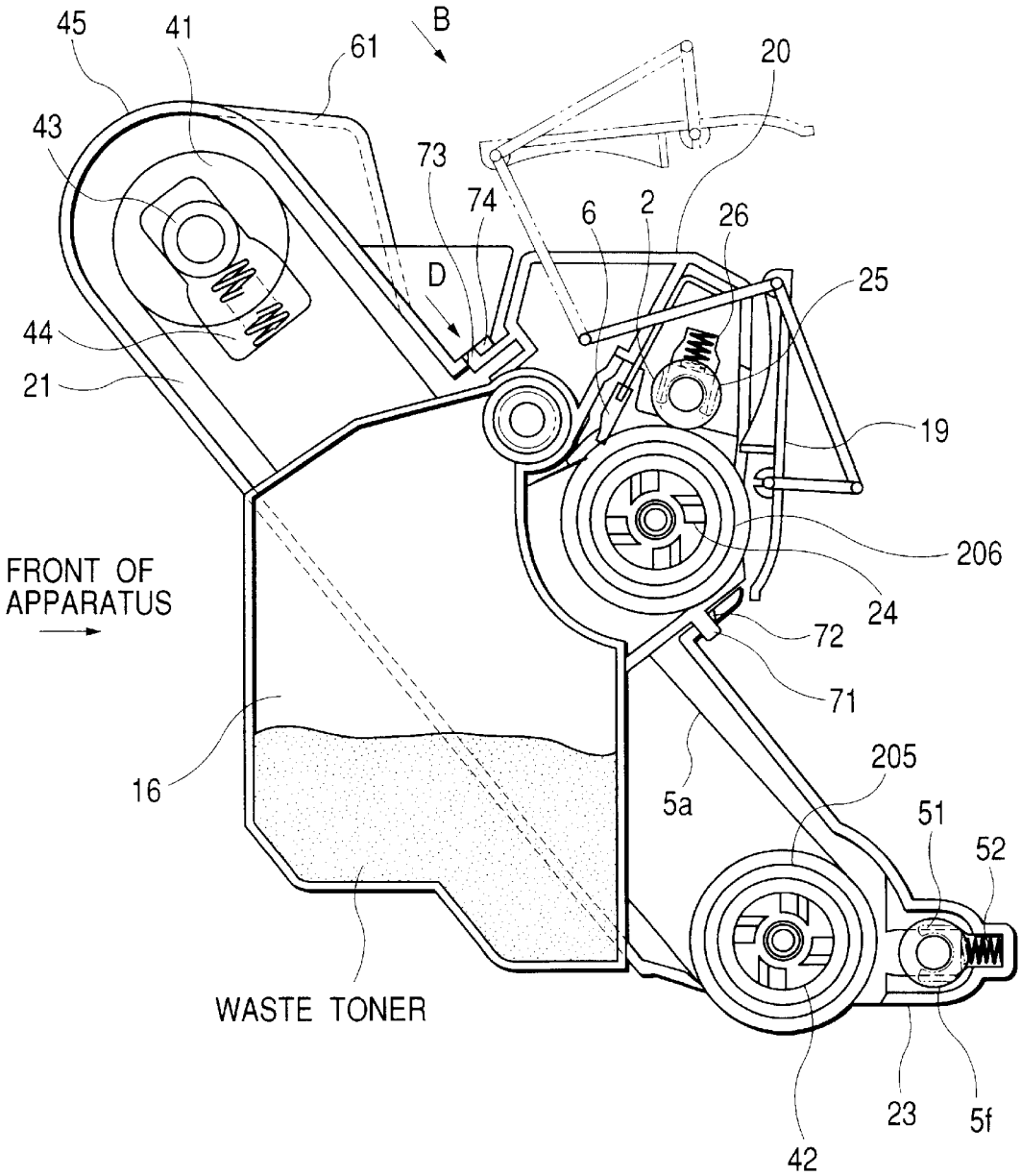
FIG. 14 is a main longitudinal cross-sectional illustration of the image forming unit as it is seen from the right thereof.

FIG. 13 is an enlarged main longitudinal cross-sectional view schematically showing the construction of the image forming unit, and more particularly is a cross-sectional view of the unit as it is seen from the left of the front of the apparatus. FIG. 14 is a longitudinal cross-sectional view of the image forming unit as it is seen from the right of the front of the apparatus. Also, FIG. 15 is a transverse cross-sectional view of the image forming unit of FIG. 13 in a waste-toner-carrying-path portion as it is seen from above it.

Figure 15:
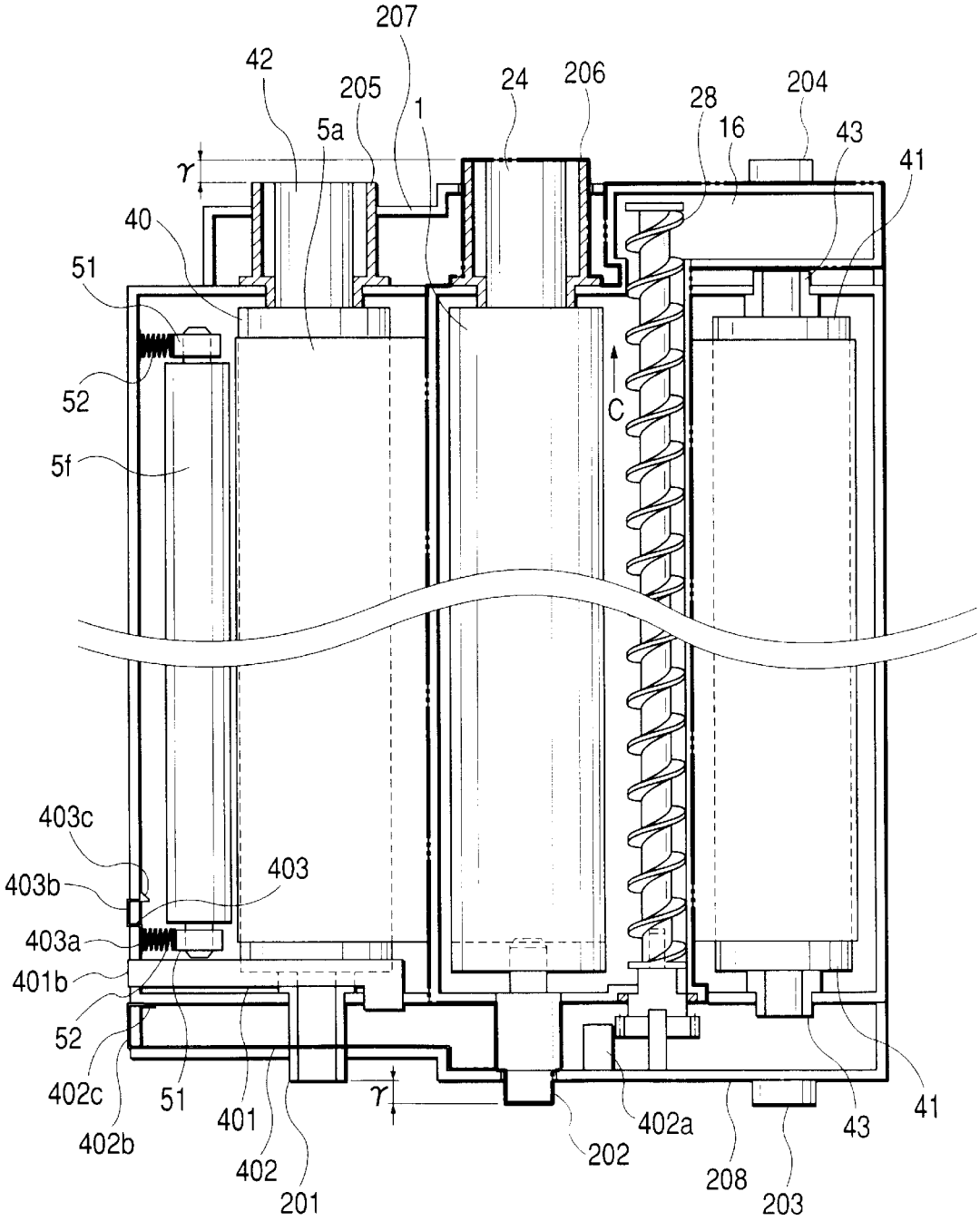
FIG. 15 is a cross-sectional illustration of the image forming unit as it is seen from above it.

In FIGS. 13 to 15, the image forming unit 5 has a photosensitive drum unit 20 disposed on the upper plane of projection of an intermediate transferring belt unit 21, and a waste toner box 16 disposed on the lower plane of projection of the intermediate transferring belt unit 21. Also, the belt driving roller 40 of the intermediate transferring belt unit 21 is provided with a cleaning charging roller portion 23 for inducing predetermined charges in residual toners on an intermediate transferring belt 5*a,* and they are of an integral construction.

Photosensitive Drum Unit

In the photosensitive drum unit 20, as shown in FIGS. 13 and 14, a photosensitive drum 1 has its opposite ends rotatably held by a right bearing 206 and a left rotary support shaft 202, and is adapted to have a predetermined rotative driving force transmitted thereto from the main body of the apparatus through the coupling 24 of the right end portion thereof.

Also, a charging roller 2 is adapted to be brought into pressure contact with the photosensitive drum 1 with a predetermined force by a compression spring 26 through bearings 25 at the opposite ends thereof, and to be driven to rotate. At least one of the bearings 25 is constituted by an electrically conductive member, and the design of the device is made such that a predetermined charging bias voltage is applied from the compression spring 26 to the charging roller 2 through the bearings 25 to thereby uniformly charge the surface of the photosensitive drum 1.

Figure 16:
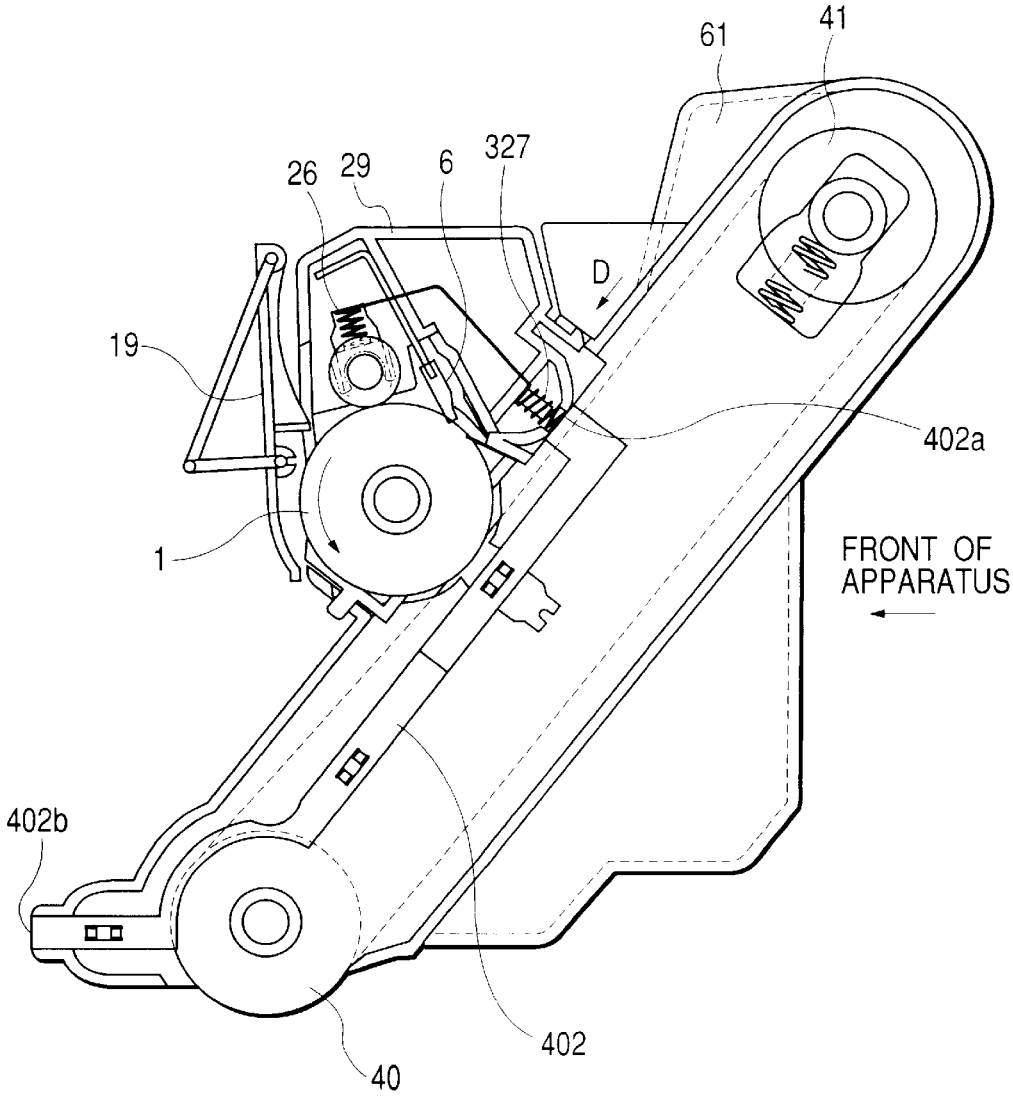
FIG. 16 is a cross-sectional illustration showing a bias voltage supplying path to a charging roller for charging a photosensitive drum.

Further, the end portion of the compression spring 26, as shown in FIG. 16, extends downwardly from the left side of a photosensitive drum frame 29 and becomes a compression spring 327, one end of which is forced into and fixed to the boss portion of the photosensitive drum frame 29.

Furthermore, a cleaning blade 6 is provided on the photosensitive drum 1 at a predetermined location, and is designed to collect the residual toners on the intermediate transferring belt in which the aforementioned predetermined charges have been induced onto the photosensitive drum 1, and scrape them off with the residual toners on the photosensitive drum 1. The waste toners thus scraped off are prevented from falling onto the intermediate transferring belt 5*a* by a dip sheet 27 (see FIG. 13), and the waste toners collected on the bottom of the photosensitive drum frame 29 are carried rightwardly as viewed from the front of the apparatus, by the rotation of a screw 28 (the direction of arrow C in FIG. 15).

Thereafter, the waste toners are carried to the right side (as viewed from the front side of the apparatus) of the photosensitive drum unit 20 by the screw 28, and slide down into and are accumulated in the waste toner box 16. Also, the photosensitive drum unit 20 is provided with a drum shutter 19 opened and closed in operative association with the operation of attaching and detaching the unit 20 to and from the main body of the image forming apparatus.

Intermediate Transferring Belt Unit

The construction of the intermediate transferring belt unit 21 will now be described. The intermediate transferring belt 5*a* is passed over a frame 45 including a grip portion 61 by a driving roller 40 and a driven roller 41 as two rotary members.

The driving roller 40 serves to give a rotational force to the intermediate transferring belt 5*a,* and is rotatably position—fixed to the frame 45. This driving roller 40 is constituted by a metal piple or the like, and has formed on its surface a layer having a high frictional force such as a rubber layer having predetermined electrical conductivity, and is adapted to function as an electrode.

As shown in FIGS. 13 to 15, the driving roller 40 has its opposite ends rotatably held by a right bearing 205 and a left bearing 201, and is adapted to have a predetermined rotative driving force transmitted thereto from the main body of the apparatus through the coupling 42 (see FIG. 14) of the right end portion thereof. Also, the left bearing 201 is constituted by an electrically conductive member and is grounded to the main body of the image forming apparatus.

Compression springs 44 are provided on bearings 43 at the opposite ends of the driven roller 41, and are mounted for movement in a direction to give predetermined tension to the intermediate transferring belt 5*a*.

A primary transferring roller 5*j* is provided at a location opposed to the photosensitive drum 1 with the intermediate transferring belt 5*a* interposed therebetween, and is adapted to be brought into pressure contact with the photosensitive drum with a predetermined force by a compression spring 47 through bearings 46 at the opposite ends thereof, and to be driven to rotate.

At least one of the bearings 46 is constituted by an electrically conductive member, and a predetermined charging bias voltage is applied to the primary transferring roller 5*j,* whereby the toner on the surface of the photosensitive drum 1 is primary-transferred onto the intermediate transferring belt 5*a*.

Figure 17:
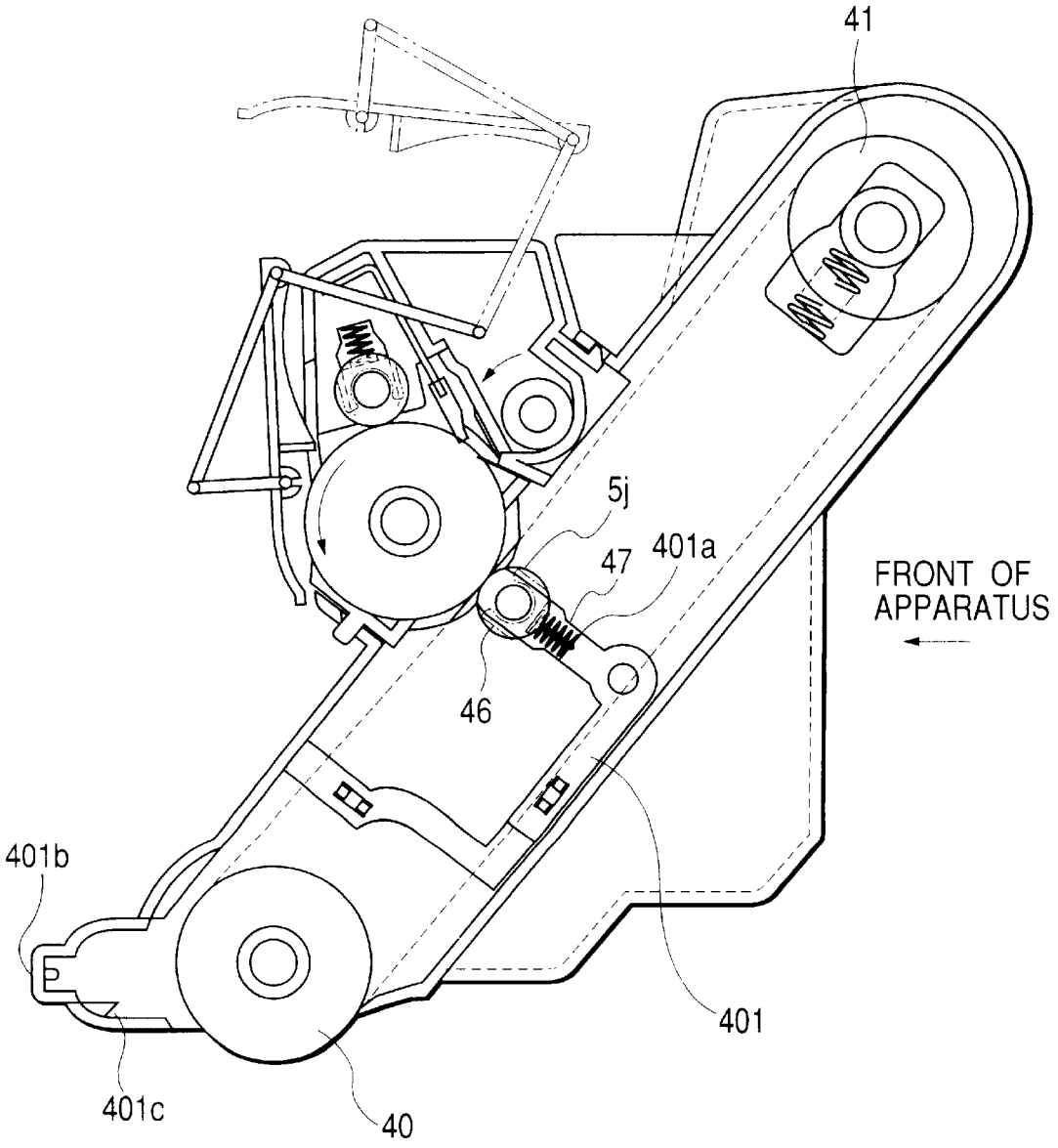
FIG. 17 is a cross-sectional illustration showing a bias voltage supplying path to a primary transferring roller.

As shown in FIG. 17, a primary transferring roller high voltage contact plate 401 is provided on the left side of the intermediate transferring body frame 45, and one end portion 401*a* thereof is connected to the compression spring 47, and the other end portion 401*b* thereof is fixed to the left lower portion of the intermediate transferring body frame 45 by a hook portion 401*c*.

Also, as shown in FIG. 13, a cleaning charging roller portion 23 for inducing predetermined charges in the residual toners on the intermediate transferring belt is provided at a location opposed to the intermediate transferring belt driving roller 40.

A cleaning charging roller 5*f* is adapted to be brought into pressure contact with the driving roller 40 with a predetermined force by a compression spring 52 through bearings 51 at the opposite ends thereof, and be driven to rotate. At least one of the bearings 51 is constituted by an electrically conductive member, and functions as an electrode member. That is, a predetermined voltage of the same polarity as that during transfer is applied to the cleaning charging roller 5*f,* whereby predetermined charges are induced in the residual toners on the intermediate transferring belt 5*a,* and the residual toners are electrostatically attracted and collected onto the surface of the drum by the photosensitive drum 1, and are accumulated in the waste toner box 16 as previously described.

In case of the charging by the charging roller 5*f,* the driving roller 40 opposed thereto with the intermediate transferring belt 5*a* interposed therebetween functions as the opposed electrode of the charging roller 5*f*. The driving roller 40 functions as a common electrode common to the secondary transferring roller 11 and the charging roller 5*f,* and it is not necessary to provide opposed electrodes individually for the secondary transferring roller 11 and the charging roller 5*f* and therefore, the downsizing of the intermediate transferring belt unit 21 becomes possible.

Also, in a state as shown in FIG. 1 wherein the image forming unit 5 is inserted in the main body of the apparatus, the charging roller 5*f* and the secondary transferring roller 11 are disposed near the driving roller 40, which becomes the opposed electrode, but the charging roller 5*f* is disposed downstream of the secondary transferring roller 11 with respect to the direction of rotation of the intermediate transferring belt 5*a* and upstream of the primary transferring portion with respect to the aforementioned direction of rotation. Therefore, the time from after secondary transfer is effected until the residual toners on the intermediate transferring belt are charged by the charging roller 5*f* can be shortened, and a reduction in the throughput of image formation when images are continuously formed on a plurality of transferring materials can be prevented.

Also, as shown in FIG. 15, the compression spring 52 is connected to one end 403*a* of a cleaning-charging-roller-high-voltage contact plate 403 constituting cleaning means, and the other end 403*b* thereof is fixed to the left lower portion of the intermediate transferring body frame 45 by a hook portion 403*c*.

Further, as shown in FIGS. 15 and 16, a charging-roller-high-voltage contact plate 402 for supplying a high voltage to the charging roller 2 is provided on the inner side of the left cover 208 of the intermediate transferring body frame 45, and one end portion 402*a* thereof is fixed to the upper surface of the intermediate transferring body frame 45, and extends downwardly from the left side of the photosensitive drum frame 29 and is connected to a compression spring 327, and the other end portion 402*b* thereof is fixed to the left lower portion of the intermediate transferring body frame 45 by a hook portion 402*c*. Thereby, the electrical power from the main body of the apparatus is supplied to one end portion 402*b* of the charging-roller-high-voltage contact plate 402, and is supplied to the charging roller 2 through the compression spring 26 and the bearings 25 because the other end portion 402*a* of the contact plate 402 and the compression spring 327 are electrically connected together as electrical contact means.

As described above, the supply contact portions of the bias voltages from the main body of the image forming apparatus to (1) the charging roller 2, (2) the primary transferring roller 5*j* and (3) the cleaning means are concentrated in the lower portions 402*b*, 401*b* and 403*b* of the left side (outside the image forming area width) of the intermediate transferring belt unit 21.

Unit Construction of the Image Forming Unit

The frame construction of the image forming unit 5 will now be described in detail. The frame construction is broadly divided into two. A first unit, as shown in FIGS. 14 and 15, is a photosensitive drum unit 20 (the portion encircled by thick chain double-dashed line in FIG. 15) comprised of the photosensitive drum frame 29 assuming a construction integral with the waste toner box 16, and in addition, the photosensitive drum 1, the right bearing 206, the left rotary support shaft 202, the charging roller 2, the cleaning blade 6, the screw 28 and the drum shutter 19 as main parts. Also, a second unit, as shown in FIG. 13, is an intermediate transferring belt unit 21 comprising the intermediate transferring belt 5*b* passed over the intermediate transferring body frame 45 by the driving roller 40 and the driven roller 41, and the primary transferring roller 5*j* disposed on the inner side of the intermediate transferring belt, which is opposed to the photosensitive drum 1, and the cleaning charging roller 5*f* disposed in opposed relationship with the driving roller 40.

The above-described two units, as shown in FIGS. 13 and 14, are such that projected portions 71 provided on the left and right ends of the photosensitive drum frame 29 are inserted in positioning holes 72 formed in the intermediate transferring body frame 45, while on the other hand, the claw 73 of a hook portion of a snap fit type provided at the widthwise center of the photosensitive drum frame 29 is fitted in and connected to the lock hole 74 of the intermediate transferring body frame 45.

The positioning holes 72 formed in the intermediate transferring body frame 45 and the lock hole 74 are larger by a predetermined amount than the projected portions 71 provided on the photosensitive drum frame 29 and the claw 73 of the hook portion, respectively, and the design of the device is such that a predetermined amount of relative position movement is possible between the photosensitive drum unit 20 and the intermediate transferring belt unit 21.

Also, the positioning holes 72 are formed with a tapered portion 72*a* (see FIG. 8) so as to facilitate the attachment and detachment.

Figure 18:
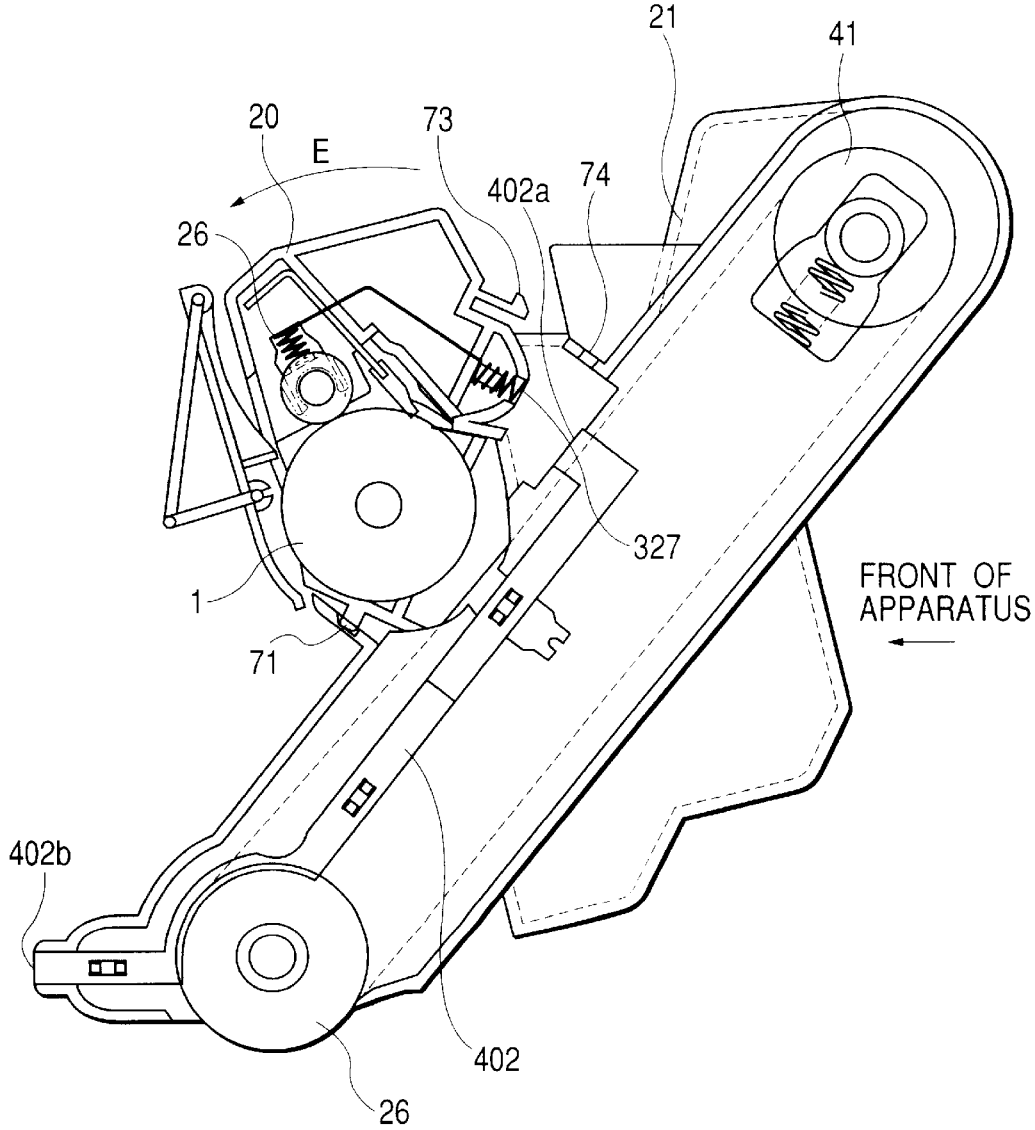
FIG. 18 is an illustration showing the situation of a high voltage contact portion when a photosensitive drum unit and an intermediate transferring body unit are divided.
Figure 19:
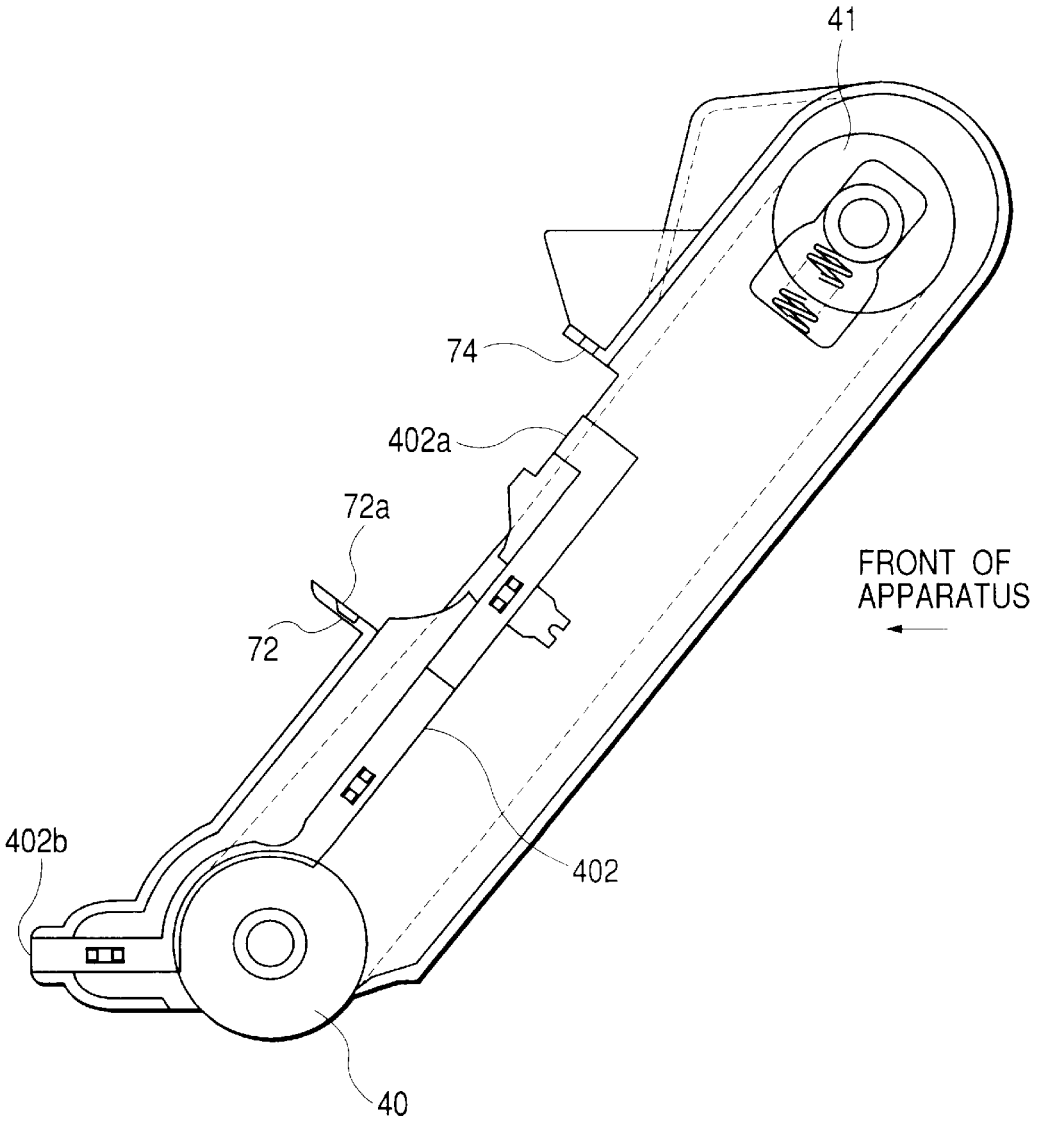
FIG. 19 is an illustration of the intermediate transferring body unit.
Figure 20:
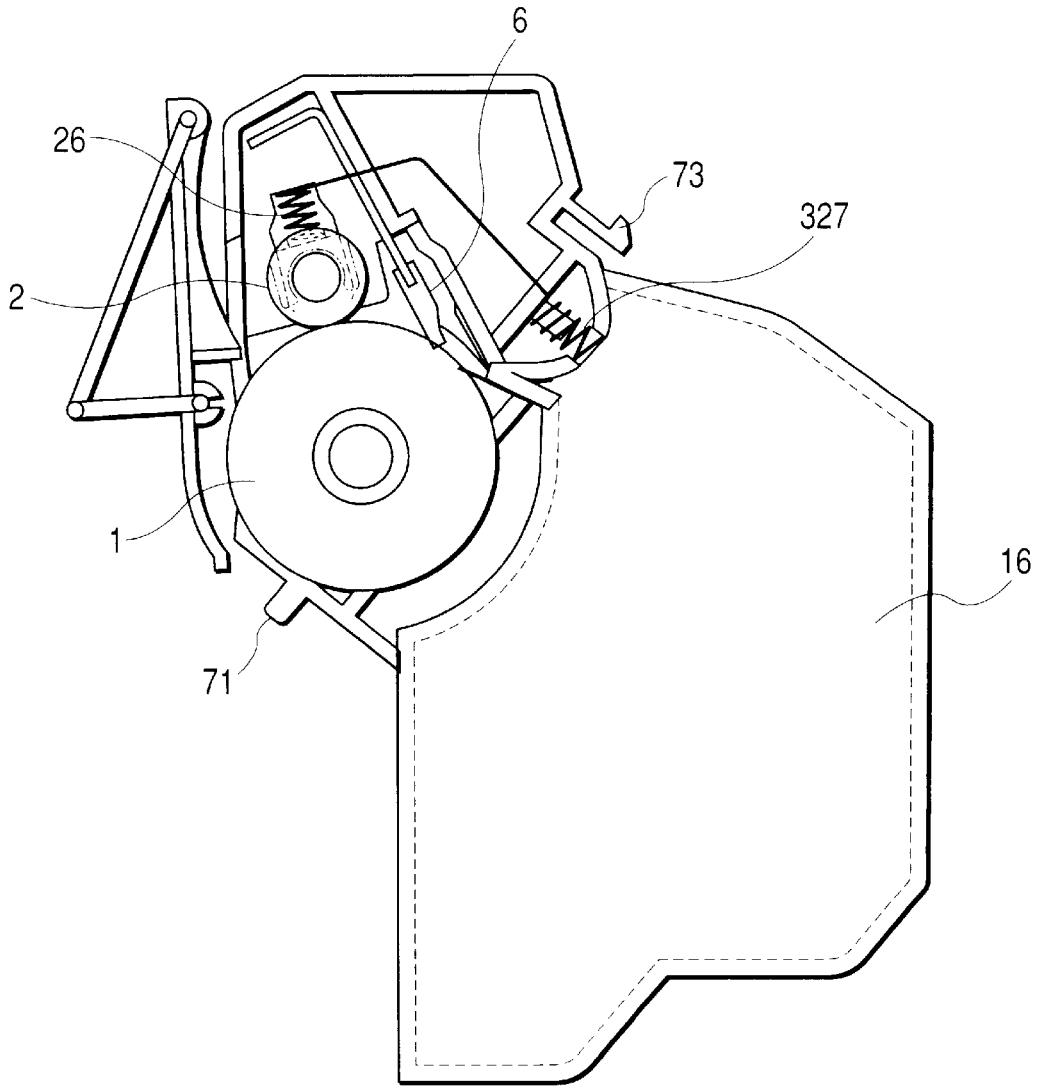
FIG. 20 is an illustration of the photosensitive drum unit.

In the above-described construction, as shown in FIG. 14, the hook claw 73 of the photosensitive drum unit 20 is pushed in the direction of arrow D to thereby disengage it from the lock hole 74 of the intermediate transferring belt unit 21, and as shown in FIG. 18, the photosensitive drum unit 20 is rotated in the direction of arrow E, whereby as shown in FIGS. 19 and 20, the image forming unit can be divided into the photosensitive drum unit 20 and the intermediate transferring belt unit 21.

When the two units 20 and 21 separated from each other are to be connected together, conversely to what has been previously described, the projected portions 71 of the photosensitive drum unit 20 are inserted into the positioning holes 72 of the intermediate transferring belt unit 21, and the photosensitive drum unit 20 is rotated in a direction opposite to the direction of arrow E in FIG. 18, and the hook claw 73 is pushed into the lock hole 74, whereby the two units 20 and 21 are connected together.

At this time, the bias voltage supplying path to the charging roller 2 is designed to be connected to and separated from the end portion 402*a* of the charging roller high voltage contact plate 402 provided on the intermediate transferring belt unit 21 side by the compression spring 327 provided on the photosensitive drum unit 20 side.

As previously described, the photosensitive drum unit 20 and the intermediate transferring belt unit 21 are separable from each other and therefore, when only the photosensitive drum 1 or only the intermediate transferring belt 5*a* has reached the end of its life, it becomes possible to interchange only the unit which has reached the end of its life. Therefore, the user's cost load is mitigated when the lives of the photosensitive drum 1 and the intermediate transferring belt 5*a* differ from each other.

The means for mounting the unit to the main body of the apparatus is similar to what has been described in connection with FIG. 10.

While in the image forming unit 5 of the aforedescribed embodiment, the photosensitive drum unit 20 and the intermediate transferring belt unit 21 are separable from each other, the two units may be constructed as an inseparable integral unit.

Also, while the image forming unit 5 of the aforedescribed embodiment has been shown with respect to an example in which the intermediate transferring belt 5*a* is supported by two rollers, i.e., the driving roller and the driven roller, the belt 5*a* may be supported by three or more rollers.

Also, while in the aforedescribed embodiment, there has been shown a color image forming apparatus for forming color images with the image forming unit 5 inserted therein, the image forming unit according to the present invention can also be used in an image forming apparatus for forming monochromatic images.

In the present embodiment, as previously described, one of the rotary members over which the belt member is passed is an electrode common to a plurality of electrode members, whereby it becomes possible to support the belt member by two rotary members, and the number of the constituent parts of the unit can be decreased to thereby achieve the downsizing of the entire main body of the apparatus, an improvement in the assembling property and a reduction in cost.

While the embodiments of the present invention have been described above, the present invention is not restricted to the above-described embodiments, but all modifications are possible within the technical idea of the present invention.

What is claimed is:

1. An image forming unit detachably attachable to an image forming apparatus, comprising:

an image bearing body;

charging means for charging said image bearing body;

a first unit having said image bearing body and said charging means;

an intermediate transferring body;

transferring means for transferring a toner image on said image bearing body to said intermediate transferring body; and a second unit having said intermediate transferring body and said transferring means, wherein one of said first unit and said second unit is supplied with electric power through the other unit.

2. An image forming unit according to claim 1, further comprising charging electrical contact means for supplying electric power from a power source of a main body side of said apparatus to said charging means, and transferring electrical contact means for supplying electric power from said power source to said transferring means, said charging electrical contact means and said transferring electrical contact means being provided in only one of said first unit and said second unit.

3. An image forming unit according to claim 2, wherein said charging electrical contact means and said transferring electrical contact means are provided in said second unit, and said charging means is supplied with electric power from said power source through said second unit.

4. An image forming unit according to claim 1, wherein said first unit and said second unit are separable from each other.

5. An image forming unit according to claim 4, wherein said first unit has first electrical contact means, said second unit has second electrical contact means, and during coupling of said first unit and said second unit, said first electrical contact means and said second electrical contact means contact each other, and giving and taking of electric power are performed between said first unit and said second unit.

6. An image forming unit according to claim 2, further comprising cleaning means for charging any residual toner on said intermediate transferring body to a polarity opposite to a regular charging polarity, and cleaning electrical contact means for supplying electric power from said power source to said cleaning means, said cleaning electrical contact means being provided in one of said first unit and said second unit in which said charging electrical contact means and said transferring electrical contact means are provided.

7. An image forming unit according to claim 6, wherein said cleaning means and said cleaning electrical contact means are provided in said second unit.

8. An image forming apparatus comprising:

an image forming unit detachably attachable to a main body of said apparatus, said image forming unit including an image bearing body, charging means for charging said image bearing body, a first unit having said image bearing body and said charging means, an intermediate transferring body, transferring means for transferring a toner image on said image bearing body to said intermediate transferring body, and a second unit having said intermediate transferring body and said transferring means, wherein one of said first unit and said second unit is supplied with electric power through the other unit.

9. An image forming apparatus according to claim 8, further comprising charging electrical contact means for supplying electric power from the power source of the main body side of said apparatus to said charging means, and transferring electrical contact means for supplying electric power from said power source to said transferring means, said charging electrical contact means and said transferring electrical contact means being provided in only one of said first unit and said second unit.

10. An image forming apparatus according to claim 9, wherein said charging electrical contact means and said transferring electrical contact means are provided in said second unit, and said charging means is supplied with electric power from said power source through said second unit.

11. An image forming apparatus according to claim 8, wherein said first unit and said second unit are separable from each other.

12. An image forming apparatus according to claim 11, wherein said first unit has first electrical contact means, said second unit has second electrical contact means, and during coupling of said first unit and said second unit, said first electrical contact means and said second electrical contact means contact each other, and giving and taking of electric power are performed between said first unit and said second unit.

13. An image forming apparatus according to claim 9, further comprising cleaning means for charging any residual toner on said intermediate transferring body to a polarity opposite to a regular charging polarity, and cleaning electrical contact means for supplying electric power from said power source to said cleaning means, said cleaning electrical contact means being provided in one of said first unit and said second unit in which said charging electrical contact means and said transferring electrical contact means are provided.

14. An image forming apparatus according to claim 13, wherein said cleaning means and said cleaning electrical contact means are provided in said second unit.

15. An image forming unit detachably attachable to an image forming apparatus, comprising:

an image bearing body;

an intermediate transferring belt to which a toner image on said image bearing body is transferred; and a rotary member over which said intermediate transferring belt is passed, said rotary member being an opposed electrode common to a plurality of members supplied with electric power.

16. An image forming unit according to claim 15, wherein one of said plurality of members is a charging member for charging any residual toner on said intermediate transferring belt to a polarity opposite to a regular charging polarity, and another one of said plurality of members is a transferring member for transferring the toner on said intermediate transferring belt to a recording material.

17. An image forming unit according to claim 16, having said charging member.

18. An image forming unit according to claim 16, wherein the residual toner on said intermediate transferring belt charged by said charging member is transferred to said image bearing body, and the transferred toner on said image bearing body is collected into toner containing means.

19. An image forming unit according to claim 15, wherein said rotary member is a driving roller for driving said intermediate transferring belt.

20. An image forming unit according to claim 19, further comprising a driven roller over which said intermediate transferring belt is passed and which is driven to rotate by said intermediate transferring belt.

21. An image forming apparatus comprising:

an image forming unit detachably attachable to a main body of said apparatus, said image forming unit including an image bearing body, an intermediate transferring belt to which a toner image on said image bearing body is transferred, and a rotary member over which said intermediate transferring belt is passed, said rotary member being an opposed electrode common to a plurality of members supplied with electric power.

22. An image forming apparatus according to claim 21, further comprising a charging member for charging any residual toner on said intermediate transferring belt to a polarity opposite to a regular charging polarity, and a transferring member for transferring the toner on said intermediate transferring belt to a recording material, one of said plurality of members being the charging member, and another one of said plurality of members being the transferring member.

23. An image forming apparatus according to claim 21, wherein said image forming unit has said charging member.

24. An image forming apparatus according to claim 22, wherein the residual toner on said intermediate transferring belt charged by said charging member is transferred to said image bearing body, and the transferred toner on said image bearing body is collected into toner containing means.

25. An image forming apparatus according to claim 21, wherein said rotary member is a driving roller for driving said intermediate transferring belt.

26. An image forming apparatus according to claim 25, further comprising a driven roller over which said intermediate transferring belt is passed and which is driven to rotate by said intermediate transferring belt.

* * * * *

UNITED STATES PATENT AND TRADEMARK OFFICE

CERTIFICATE OF CORRECTION

PATENT NO. : 6,522,845 B2
DATED : February 18, 2003
INVENTOR(S) : Takao Sameshima It is certified that error appears in the above-identified patent and that said Letters Patent is hereby corrected as shown below:

Column 4,
Line 61, “ante-registration” should read -- anti-registration --.

Column 5,
Line 51, “cross sectional” should read -- cross-sectional --.

Column 9,
Line 18, “had” should read -- made --.

Column 11,
Lines 39 and 49, “attachably” should read -- attachable --.

Column 13,
Line 10, “present is” should read -- present in --.
Line 51, “47 pmm” should read -- 47 πmm --.
Line 57, “47 π = 2” should read -- 47 π x 2 --.
Line 57, “47 π3” should read -- 47 π x 3 --.
Line 59, “i.e.” should read -- i.e.; --.

Signed and Sealed this

Eighteenth Day of November, 2003

JAMES E. ROGAN
*Director of the United States Patent and Trademark Office*